US011155943B2

(12) United States Patent
Dua et al.

(10) Patent No.: US 11,155,943 B2
(45) Date of Patent: Oct. 26, 2021

(54) KNIT COMPONENT BONDING

(71) Applicant: NIKE, Inc., Beaverton, OR (US)

(72) Inventors: Bhupesh Dua, Portland, OR (US); Karen A. Hawkinson, Portland, OR (US); Benjamin A. Shaffer, Saratoga, CA (US)

(73) Assignee: NIKE, INC., Beaverton, OR (US)

( * ) Notice: Subject to any disclaimer, the term of this patent is extended or adjusted under 35 U.S.C. 154(b) by 0 days.

(21) Appl. No.: 16/887,894

(22) Filed: May 29, 2020

(65) Prior Publication Data

US 2020/0291554 A1 Sep. 17, 2020

Related U.S. Application Data

(60) Continuation of application No. 16/129,248, filed on Sep. 12, 2018, which is a continuation of application
(Continued)

(51) Int. Cl.

| | |
|---|---|
| ***D04B 1/16*** | (2006.01) |
| ***D04B 21/16*** | (2006.01) |
| ***A43B 23/02*** | (2006.01) |
| ***A43B 1/04*** | (2006.01) |
| ***D04B 1/24*** | (2006.01) |

(52) U.S. Cl.

CPC ..... *D04B 1/16* (2013.01); *A43B 1/04* (2013.01); *A43B 23/0205* (2013.01); *D04B 1/24* (2013.01); *D04B 21/16* (2013.01); *D10B 2401/041* (2013.01); *D10B 2403/0114* (2013.01); *D10B 2501/043* (2013.01); *Y10T 442/40* (2015.04)

(58) Field of Classification Search

CPC .. D04B 21/16; D04B 1/16; D04B 1/24; A43B 1/04

See application file for complete search history.

(56) References Cited

U.S. PATENT DOCUMENTS

| | | | |
|---|---|---|---|
| 601,192 | A | 3/1898 | Woodside |
| 1,215,198 | A | 2/1917 | Rothstein |

(Continued)

FOREIGN PATENT DOCUMENTS

| | | | |
|---|---|---|---|
| CN | 1084719 | A | 4/1994 |
| CN | 2275378 | Y | 3/1998 |

(Continued)

OTHER PUBLICATIONS

Declaration and Curriculum Vitae of Dr. Edward C. Frederick, Exhibit 1001 in IPR2013-00067, Nov. 28, 2012, 178 pages.

(Continued)

*Primary Examiner* — Danny Worrell

(74) *Attorney, Agent, or Firm* — Shook, Hardy & Bacon L.L.P.

(57) ABSTRACT

A composite structure may include a knit component and a bonded component. The knit component has a first surface and an opposite second surface, and the knit component includes a fusible yarn and a non-fusible yarn that form a knitted structure. The fusible yarn is at least partially formed from a thermoplastic polymer material, and the fusible yarn is located on at least the first surface. The bonded component is positioned adjacent to the first surface, and the bonded component is thermal bonded to the first surface with the thermoplastic polymer material of the fusible yarn.

20 Claims, 28 Drawing Sheets

Related U.S. Application Data

No. 14/845,979, filed on Sep. 4, 2015, now Pat. No. 10,094,053, which is a division of application No. 13/100,689, filed on May 4, 2011, now Pat. No. 9,150,986.

(56) References Cited

U.S. PATENT DOCUMENTS

| | | | |
|---|---|---|---|
| 1,597,934 | A | 8/1926 | Stimpson |
| 1,888,172 | A | 11/1932 | Joha |
| 1,902,780 | A | 3/1933 | Holden et al. |
| 1,910,251 | A | 5/1933 | Joha |
| 2,001,293 | A | 5/1935 | Wilson |
| 2,047,724 | A | 7/1936 | Zuckerman |
| 2,147,197 | A | 2/1939 | Glidden |
| 2,308,593 | A | 1/1943 | Brew |
| 2,314,098 | A | 3/1943 | McDonald |
| 2,330,199 | A | 9/1943 | Basch |
| 2,343,390 | A | 3/1944 | Ushakoff |
| 2,400,692 | A | 5/1946 | Herbert |
| 2,440,393 | A | 4/1948 | Clark |
| 2,569,764 | A | 10/1951 | Jonas |
| 2,586,045 | A | 2/1952 | Hoza |
| 2,608,078 | A | 8/1952 | Anderson |
| 2,641,004 | A | 6/1953 | Whiting et al. |
| 2,675,631 | A | 4/1954 | Carr |
| 2,811,029 | A | 10/1957 | Conner |
| 3,457,739 | A | 7/1969 | Frand et al. |
| 3,583,081 | A | 6/1971 | Hayashi |
| 3,620,892 | A | 11/1971 | Wincklhofer et al. |
| 3,669,157 | A | 6/1972 | Woodall et al. |
| 3,694,940 | A | 10/1972 | Stohr |
| 3,704,474 | A | 12/1972 | Winkler |
| 3,766,566 | A | 10/1973 | Tadokoro |
| 3,778,856 | A | 12/1973 | Chriestie et al. |
| 3,796,066 | A | 3/1974 | Millar |
| 3,821,012 | A | 6/1974 | Lattarulo et al. |
| 3,952,427 | A | 4/1976 | von den Benken et al. |
| 3,972,086 | A | 8/1976 | Belli et al. |
| 4,027,402 | A | 6/1977 | Liu et al. |
| 4,031,586 | A | 6/1977 | von den Benken et al. |
| 4,211,806 | A | 7/1980 | Civardi et al. |
| 4,255,949 | A | 3/1981 | Thorneburg |
| 4,317,292 | A | 3/1982 | Melton |
| 4,320,634 | A | 3/1982 | Hashimoto et al. |
| 4,372,998 | A | 2/1983 | Shimada |
| 4,373,361 | A | 2/1983 | Thorneburg |
| 4,447,967 | A | 5/1984 | Zaino |
| 4,465,448 | A | 8/1984 | Aldridge |
| 4,607,439 | A | 8/1986 | Sogabe et al. |
| 4,733,545 | A | 3/1988 | Weinle et al. |
| 4,737,396 | A | 4/1988 | Kamat |
| 4,750,339 | A | 6/1988 | Simpson et al. |
| 4,756,098 | A | 7/1988 | Boggia |
| 4,785,558 | A | 11/1988 | Shiomura |
| 4,813,158 | A | 3/1989 | Brown |
| 4,842,661 | A | 6/1989 | Miller et al. |
| 5,095,720 | A | 3/1992 | Tibbals, Jr. |
| 5,152,025 | A | 10/1992 | Hirmas |
| 5,158,636 | A | 10/1992 | Groitzsch et al. |
| 5,192,601 | A | 3/1993 | Neisler |
| 5,345,638 | A | 9/1994 | Nishida |
| 5,353,524 | A | 10/1994 | Brier |
| 5,461,884 | A | 10/1995 | McCartney et al. |
| 5,511,323 | A | 4/1996 | Dahlgren |
| 5,572,860 | A | 11/1996 | Mitsumoto et al. |
| 5,575,090 | A | 11/1996 | Condini |
| 5,729,918 | A | 3/1998 | Smets |
| 5,735,145 | A | 4/1998 | Pernick |
| 5,746,013 | A | 5/1998 | Fay, Sr. |
| 5,888,609 | A | 3/1999 | Karttunen et al. |
| 5,889,229 | A | 3/1999 | Sosnowski |
| 5,945,357 | A | 8/1999 | Quigley |
| 5,972,477 | A | 10/1999 | Kim et al. |
| 6,027,615 | A | 2/2000 | Davenport et al. |
| 6,071,578 | A | 6/2000 | Richardson et al. |
| 6,308,438 | B1 | 10/2001 | Throneburg et al. |
| 6,333,105 | B1 | 12/2001 | Tanaka et al. |
| 6,397,638 | B1 | 6/2002 | Roell |
| 6,462,267 | B1 | 10/2002 | Spies et al. |
| 6,558,784 | B1 | 5/2003 | Norton et al. |
| 6,588,237 | B2 | 7/2003 | Cole et al. |
| 6,696,122 | B1 | 2/2004 | Deschamps |
| 6,726,809 | B2 | 4/2004 | Joyce et al. |
| 6,910,288 | B2 | 6/2005 | Dua |
| 6,931,762 | B1 | 8/2005 | Dua |
| 7,047,668 | B2 | 5/2006 | Burris et al. |
| 7,051,460 | B2 | 5/2006 | Orei et al. |
| 7,056,402 | B2 | 6/2006 | Koerwien et al. |
| 7,270,151 | B2 | 9/2007 | Nagura et al. |
| 7,347,011 | B2 | 3/2008 | Dua et al. |
| 7,347,229 | B2 | 3/2008 | Glenn et al. |
| 7,682,219 | B2 | 3/2010 | Falla |
| 7,770,307 | B2 | 8/2010 | Meschter |
| 7,779,654 | B2 | 8/2010 | Garus |
| 7,820,569 | B2 | 10/2010 | Hwang et al. |
| 7,823,420 | B2 | 11/2010 | Andrieu et al. |
| 7,870,681 | B2 | 1/2011 | Meschter |
| 7,932,194 | B2 | 4/2011 | Bader et al. |
| 7,975,404 | B2 | 7/2011 | Goldberg |
| 8,028,440 | B2 | 10/2011 | Sokolowski et al. |
| 8,058,188 | B2 | 11/2011 | Salitsky et al. |
| 8,074,375 | B2 | 12/2011 | Longuet |
| 8,088,698 | B2 | 1/2012 | Polegato Moretti |
| 8,252,705 | B2 | 8/2012 | King et al. |
| 8,312,644 | B2 | 11/2012 | Peikert et al. |
| 8,490,299 | B2 | 7/2013 | Dua et al. |
| 8,800,172 | B2 | 8/2014 | Dua et al. |
| 9,107,459 | B2 | 8/2015 | Mayer et al. |
| 9,150,986 | B2 | 10/2015 | Dua et al. |
| 2002/0078599 | A1 | 6/2002 | Delgorgue et al. |
| 2002/0148258 | A1 | 10/2002 | Cole et al. |
| 2003/0126762 | A1 | 7/2003 | Tseng |
| 2003/0191427 | A1 | 10/2003 | Jay et al. |
| 2004/0118018 | A1 | 6/2004 | Dua |
| 2005/0081402 | A1 | 4/2005 | Orei et al. |
| 2005/0115284 | A1 | 6/2005 | Dua |
| 2005/0193592 | A1 | 9/2005 | Dua et al. |
| 2005/0284000 | A1 | 12/2005 | Kerns |
| 2006/0048413 | A1 | 3/2006 | Sokolowski et al. |
| 2007/0180730 | A1 | 8/2007 | Greene et al. |
| 2007/0294920 | A1 | 12/2007 | Baychar |
| 2008/0014817 | A1 | 1/2008 | Zafiroglu et al. |
| 2008/0017294 | A1 | 1/2008 | Bailey et al. |
| 2008/0110048 | A1 | 5/2008 | Dua et al. |
| 2008/0189830 | A1 | 8/2008 | Egglesfield |
| 2008/0313939 | A1 | 12/2008 | Ardill |
| 2009/0047496 | A1 | 2/2009 | Hansen |
| 2009/0049870 | A1 | 2/2009 | Garus |
| 2009/0068908 | A1 | 3/2009 | Hinchcliff |
| 2009/0126225 | A1 | 5/2009 | Jarvis |
| 2010/0018075 | A1 | 1/2010 | Meschter et al. |
| 2010/0037483 | A1 | 2/2010 | Meschter et al. |
| 2010/0051132 | A1 | 3/2010 | Glenn |
| 2010/0154256 | A1 | 6/2010 | Dua |
| 2010/0167617 | A1 | 7/2010 | Sato et al. |
| 2010/0170651 | A1 | 7/2010 | Scherb et al. |
| 2010/0229429 | A1 | 9/2010 | Longuet |
| 2010/0251491 | A1 | 10/2010 | Dojan et al. |
| 2011/0078921 | A1 | 4/2011 | Greene et al. |
| 2011/0088285 | A1 | 4/2011 | Dojan et al. |
| 2012/0023778 | A1 | 2/2012 | Dojan et al. |
| 2012/0255201 | A1 | 10/2012 | Little |
| 2012/0279260 | A1 | 11/2012 | Dua et al. |
| 2013/0243985 | A1 | 9/2013 | Furuta et al. |
| 2016/0058101 | A1 | 3/2016 | Dua et al. |
| 2019/0010638 | A1 | 1/2019 | Dua et al. |

FOREIGN PATENT DOCUMENTS

| | | | |
|---|---|---|---|
| CN | 2598391 | Y | 1/2004 |
| CN | 1518910 | A | 8/2004 |
| CN | 1637187 | A | 7/2005 |
| CN | 201263419 | Y | 7/2009 |

(56) References Cited

FOREIGN PATENT DOCUMENTS

| | | | |
|---|---|---|---|
| DE | 1084173 | | 6/1960 |
| DE | 237190 | A1 | 7/1986 |
| DE | 294057 | A5 | 9/1991 |
| DE | 19738433 | A1 | 4/1998 |
| DE | 19728848 | A1 | 1/1999 |
| DE | 102012206062 | A1 | 10/2013 |
| EP | 0448714 | A1 | 10/1991 |
| EP | 0728860 | A1 | 8/1996 |
| EP | 0758693 | A1 | 2/1997 |
| EP | 1233091 | A1 | 8/2002 |
| EP | 2649898 | A1 | 10/2013 |
| EP | 2649898 | B1 | 6/2018 |
| FR | 2171172 | | 9/1973 |
| GB | 538865 | | 8/1941 |
| GB | 1273524 | | 5/1972 |
| GB | 1588309 | | 4/1981 |
| GB | 1603487 | | 11/1981 |
| IL | 32732 | A | 2/1973 |
| JP | 49-13947 | | 2/1974 |
| JP | 1-153923 | A | 6/1989 |
| JP | 6-113905 | A | 4/1994 |
| JP | 8-3877 | A | 1/1996 |
| JP | 8-109553 | A | 4/1996 |
| JP | 9-56409 | A | 3/1997 |
| JP | 10-130991 | A | 5/1998 |
| JP | 11-170461 | A | 6/1999 |
| JP | 11-302943 | A | 11/1999 |
| JP | 2005-344225 | A | 12/2005 |
| JP | 2008-114382 | A | 5/2008 |
| NL | 7304678 | | 10/1974 |
| WO | 90/03744 | A1 | 4/1990 |
| WO | 97/38037 | A1 | 10/1997 |
| WO | 97/38060 | A1 | 10/1997 |
| WO | 00/32861 | A1 | 6/2000 |
| WO | 01/12896 | A1 | 2/2001 |
| WO | 02/31247 | A1 | 4/2002 |
| WO | 2005/052235 | A1 | 6/2005 |
| WO | 2007/014145 | A1 | 2/2007 |
| WO | 2012/125490 | A2 | 9/2012 |
| WO | 2012/151408 | A2 | 11/2012 |

OTHER PUBLICATIONS

Ebrle et al., "Clothing Technology" ,Sixth German Edition and Third English Edition, Verlag EuropaLehrmittel, Nourney, Vollmer GmbH & Co., Exhibit 1013 in IPR2013-00067, Nov. 28, 2012, 3 pages.

Letter from Bruce Huffa, Dec. 23, 2013, 71 pages.

Spencer, David J. , "Knitting Technology, A Comprehensive Handbook and Practical Guide", Third Edition, Woodhead Publishing Limited, Abington Hall, Abington Cambridge, Exhibit 1012 in IPR2013-00067, Nov. 28, 2012, 413 pages.

Non-Final Office Action received for U.S. Appl. No. 16/887,875, dated Nov. 24, 2020, 6 pages.

Non-Final Office Action received for U.S. Appl. No. 16/887,875, dated Mar. 17, 2021, 7 pages.

Non-Final Office Action received for U.S. Appl. No. 16/129,248, dated Feb. 4, 2021, 8 pages.

Notice of Allowance received for U.S. Appl. No. 16/887,875, dated Jun. 28, 2021, 6 pages.

Notice of Allowance received for U.S. Appl. No. 16/129,248, dated Aug. 19, 2021, 5 pages.

KNIT COMPONENT BONDING

CROSS REFERENCE TO RELATED APPLICATIONS

This application is a continuation of U.S. patent application Ser. No. 16/129,248, filed on Sep. 12, 2018, which is a continuation of U.S. patent application Ser. No. 14/845,979, filed on Sep. 4, 2015, now U.S. Pat. No. 10,094,053, which is a divisional of U.S. patent application Ser. No. 13/100,689, filed on May 4, 2011, now U.S. Pat. No. 9,150,986, all of which are incorporated herein in their entireties by reference.

BACKGROUND

Knit components having a wide range of knitted structures, materials, and properties may be utilized in a variety of products. As examples, knit components may be utilized in apparel (e.g., shirts, pants, socks, jackets, undergarments, footwear), athletic equipment (e.g., golf bags, baseball and football gloves, soccer ball restriction structures), containers (e.g., backpacks, bags), and upholstery for furniture (e.g., chairs, couches, car seats). Knit components may also be utilized in bed coverings (e.g., sheets, blankets), table coverings, towels, flags, tents, sails, and parachutes. Knit components may be utilized as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, knit components may be incorporated into a variety of products for both personal and industrial purposes.

SUMMARY

A composite structure is disclosed below as including a knit component and a bonded component. The knit component has a first surface and an opposite second surface, and the knit component includes a fusible yarn and a non-fusible yarn that form a knitted structure. The fusible yarn is at least partially formed from a thermoplastic polymer material, and the fusible yarn is located on at least the first surface. The bonded component is positioned adjacent to the first surface, and the bonded component is thermal bonded to the first surface with the thermoplastic polymer material of the fusible yarn.

A method of manufacturing a composite element is also disclosed below. The method includes knitting a textile with a fusible yarn and a non-fusible yarn to locate the fusible yarn on at least one surface of the textile. The surface of the textile is located in contact with a bonded component. Additionally, the textile and the bonded component are heated to form a thermal bond between a thermoplastic polymer material of the fusible yarn and the bonded component.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various concepts associated with knit component bonding.

Composite Element Configuration

Figure 1:
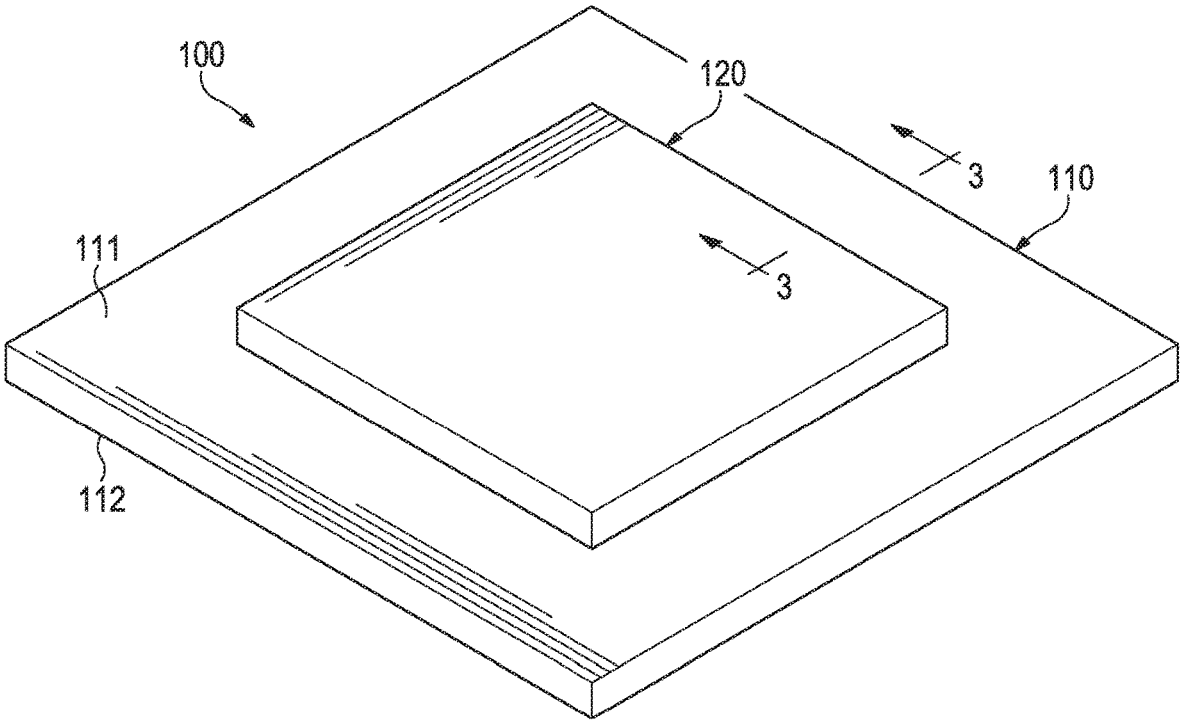
FIG. 1 is a perspective view of a composite element.
Figure 2:
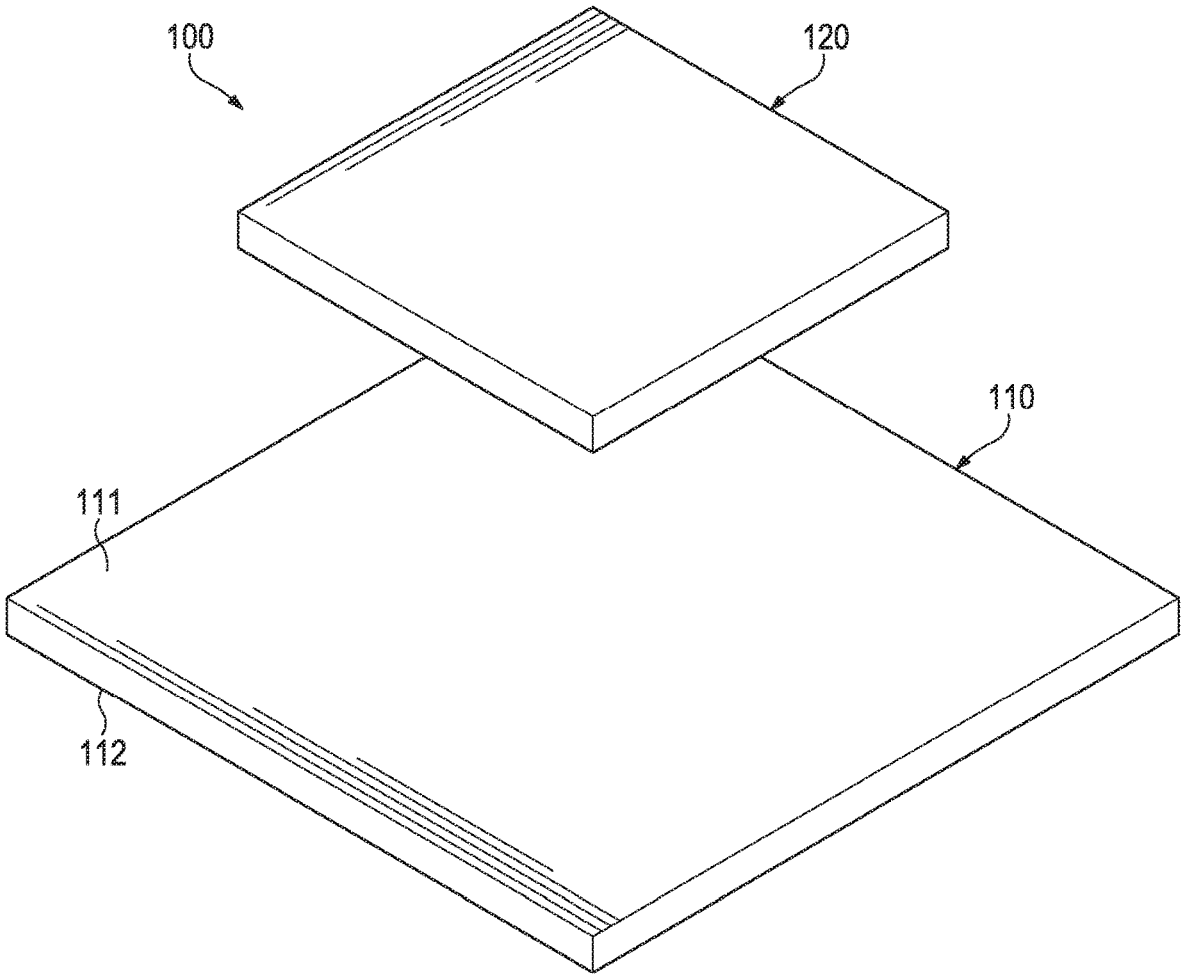
FIG. 2 is an exploded perspective view of the composite element.

A composite element 100 is depicted in FIGS. 1 and 2 as including a knit component 110 and a bonded component 120. Components 110 and 120 are secured together through knit component bonding. Although described in greater detail below, knit component bonding generally includes utilizing a fusible material (e.g., a thermoplastic polymer material) within knit component 110 to form a thermal bond that joins or otherwise secures components 110 and 120 to each other. That is, bonded component 120 is joined through thermal bonding to knit component 110 with the fusible material from knit component 110. The various configurations of composite element 100 discussed below provide examples of general configurations in which knit component bonding may be implemented. As such, the various configurations of composite element 100 may be utilized in a variety of products, including many of the products discussed in the Background above. In order to provide specific examples of the manner in which knit component bonding may be implemented, however, various articles of apparel, including a shirt 200 and an article of footwear 300, are described below.

Figure 3:
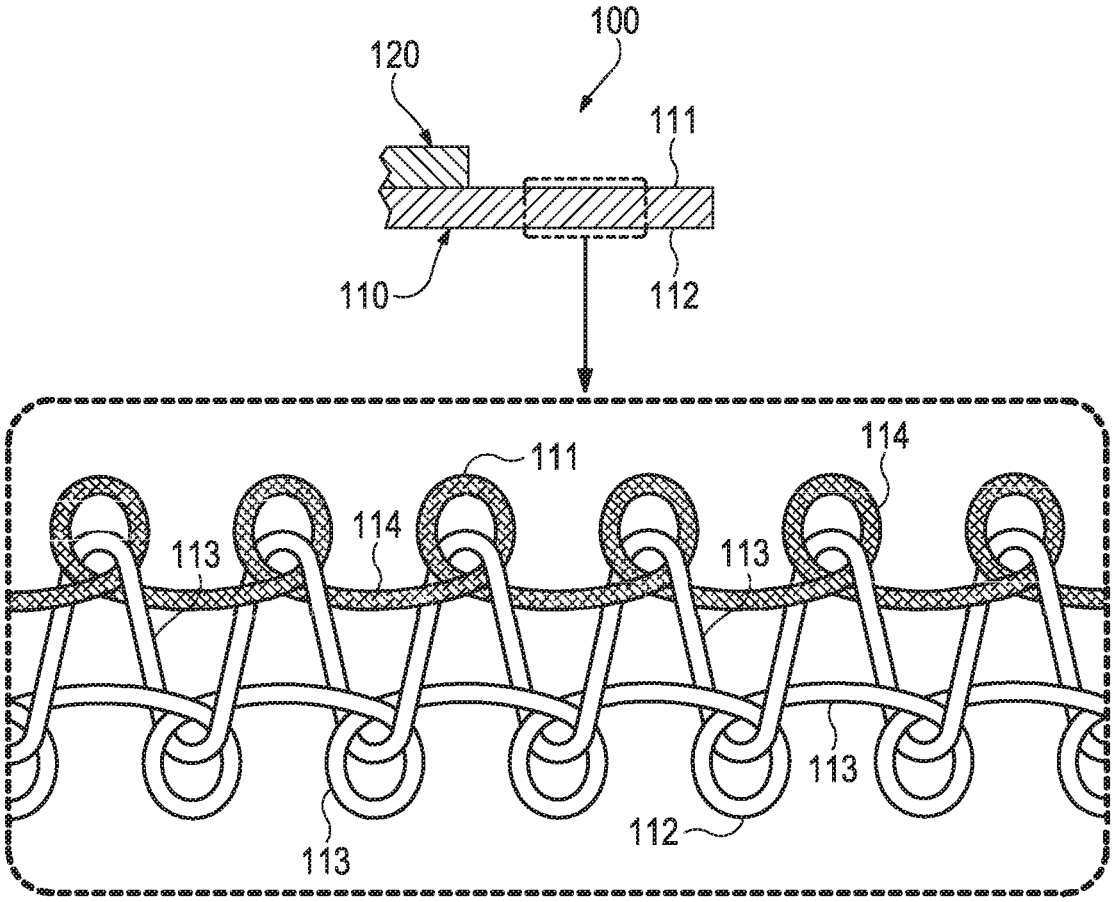
FIG. 3 is a schematic cross-sectional view of the composite element, as defined by section line 3-3 in FIG. 1.

Knit component 110 is manufactured through a knitting process to have a generally planar configuration that defines a first surface 111 and an opposite second surface 112. The knitting process forms knit component 110 from a non-fusible yarn 113 and a fusible yarn 114, as depicted in FIG. 3. That is, knit component 110 has a knitted structure in which yarns 113 and 114 are mechanically-manipulated together during the knitting process. Various types of knitting processes may be utilized to form knit component 110, including hand knitting, flat knitting, wide tube circular knitting, narrow tube circular knit jacquard, single knit circular knit jacquard, double knit circular knit jacquard, warp knit tricot, warp knit raschel, and double needle bar raschel, for example. Moreover, any knitting process that may form a knitted structure from at least two yarns (e.g., yarns 113 and 114) may be utilized to manufacture knit component 110.

Whereas non-fusible yarn 113 is formed from a non-fusible material, fusible yarn 114 is formed from a fusible material. Examples of non-fusible materials include various thermoset polymer materials (e.g., polyester, acrylic) and natural fibers (e.g., cotton, silk, wool). When subjected to moderate levels of heat, thermoset polymer materials tend to remain stable. Moreover, when subjected to elevated levels of heat, thermoset polymer materials and natural fibers may burn or otherwise degrade. Examples of fusible materials include various thermoplastic polymer materials (e.g., polyurethane, polyester, nylon). In contrast with thermoset polymer materials and natural fibers, thermoplastic polymer materials melt when heated and return to a solid state when cooled. More particularly, thermoplastic polymer materials transition from a solid state to a softened or liquid state when subjected to sufficient heat, and then the thermoplastic polymer materials transition from the softened or liquid state to the solid state when sufficiently cooled. In some configurations, the non-fusible material used for non-fusible yarn 113 may also be a thermoplastic polymer material, particularly where the melting temperature of the thermoplastic polymer material used for non-fusible yarn 113 is greater than the melting temperature of the thermoplastic polymer material used for fusible yarn 114.

Thermoplastic polymer materials, as discussed above, melt when heated and return to a solid state when cooled. Based upon this property, the thermoplastic polymer material from fusible yarn 114 may be utilized to form a thermal bond that joins knit component 110 and bonded component 120. As utilized herein, the term "thermal bonding" or variants thereof is defined as a securing technique between two components that involves a softening or melting of a thermoplastic polymer material within at least one of the components such that the components are secured to each other when cooled. Similarly, the term "thermal bond" or variants thereof is defined as the bond, link, or structure that joins two components through a process that involves a softening or melting of a thermoplastic polymer material within at least one of the components such that the components are secured to each other when cooled.

As general examples, thermal bonding may involve (a) the melting or softening of thermoplastic polymer materials within two components such that the thermoplastic polymer materials intermingle with each other (e.g., diffuse across a boundary layer between the thermoplastic polymer materials) and are secured together when cooled; (b) the melting or softening of a thermoplastic polymer material within a first component such that the thermoplastic polymer material extends into or infiltrates the structure of a second component to secure the components together when cooled; and (c) the melting or softening of a thermoplastic polymer material within a first component such that the thermoplastic polymer material extends into or infiltrates crevices or cavities of a second component to secure the components together when cooled. As such, thermal bonding may occur when two components include thermoplastic polymer materials or when only one of the components includes a thermoplastic polymer material. Additionally, thermal bonding does not generally involve the use of stitching, adhesives, or other joining techniques, but involves directly bonding components to each other with a thermoplastic polymer material. In some situations, however, stitching, adhesives, or other joining techniques may be utilized to supplement the thermal bond or the joining of components through thermal bonding.

More specific examples of thermal bonding that relate to composite element 100 will now be discussed. In general, bonded component 120 may be any element that is joined with knit component 110, including textile elements (e.g., knit textiles, woven textiles, non-woven textiles), polymer sheets, polymer foam layers, leather or rubber elements, and plates, for example. In a configuration where bonded component 120 is formed from a textile element, thermal bonding may involve the melting or softening of a thermoplastic polymer material within fusible yarn 114 such that the thermoplastic polymer material extends into the textile element of bonded component 120 and around individual filaments, fibers, or yarns within the textile element to secure components 110 and 120 together when cooled. In a similar configuration where bonded component 120 is formed from a textile element incorporating a thermoplastic polymer material, thermal bonding may involve the melting or softening of thermoplastic polymer materials within each of fusible yarn 114 and the textile element of bonded component 120 such that the thermoplastic polymer materials intermingle with each other and are secured together when cooled. Moreover, in any configuration where bonded component 120 incorporates a thermoplastic polymer material (e.g., textiles, polymer sheets, polymer foam layers, leather or rubber elements, plates), thermal bonding may involve the melting or softening of thermoplastic polymer materials within each of fusible yarn 114 and bonded component 120 such that the thermoplastic polymer materials intermingle with each other and are secured together when cooled. Additionally, in a configuration where bonded component 120 is a polymer sheet, polymer foam layer, leather or rubber element, or plate, thermal bonding may involve the melting or softening of a thermoplastic polymer material within fusible yarn 114 such that the thermoplastic polymer material extends into crevices or cavities of bonded component 120 to secure components 110 and 120 together when cooled. Although many configurations of composite element 100 do not involve the use of stitching, adhesives, or other joining techniques, these joining techniques may be utilized to supplement the thermal bond or the joining of components 110 and 120 through thermal bonding.

Based upon the above discussion, knit component bonding generally includes utilizing a fusible material (e.g., a thermoplastic polymer material) within fusible yarn 114 of knit component 110 to form a thermal bond that joins or otherwise secures components 110 and 120 to each other. That is, bonded component 120 is joined through thermal bonding to knit component 110 with the fusible material from fusible yarn 114. In order to form the thermal bond, the fusible material is often located in a portion of knit component 110 that is adjacent to bonded component 120. Given that bonded component 120 is secured to first surface 111, therefore, the fusible material is often located at first surface 111 to thereby form a thermal bond with bonded component 120 at first surface 111. Referring to FIG. 3, non-fusible yarn 113 effectively extends throughout knit component 110 and from first surface 111 to second surface 112, whereas fusible yarn 114 is concentrated at first surface 111. In this configuration, the fusible material of fusible yarn 114 is positioned to contact bonded component 120 and form the thermal bond between components 110 and 120 at first surface 111. Any knit structure where a yarn (e.g., fusible yarn 114) is concentrated or present at one or both surfaces may be utilized to achieve this configuration.

Figure 4A:
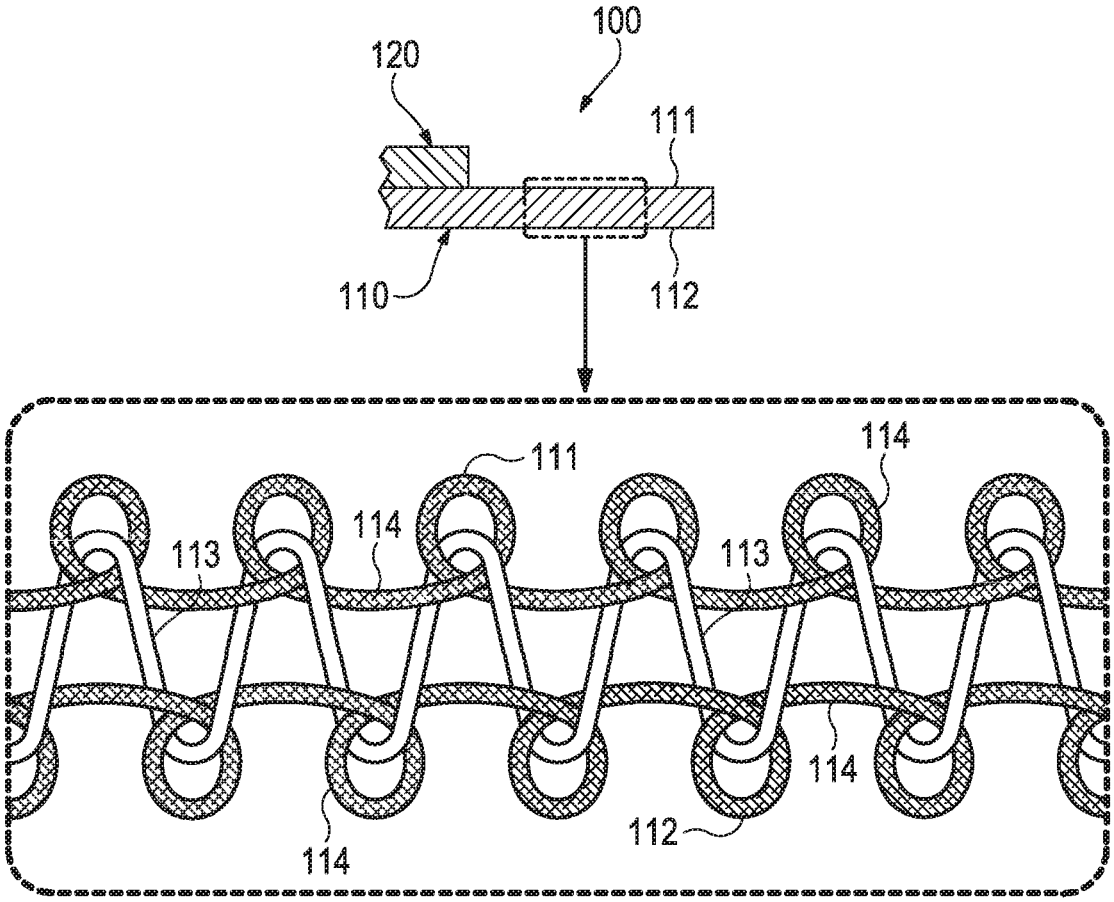
FIGS. 4A-4C are schematic cross-sectional views corresponding with FIG. 3 and depicting further configurations of the composite element.
Figure 4B:
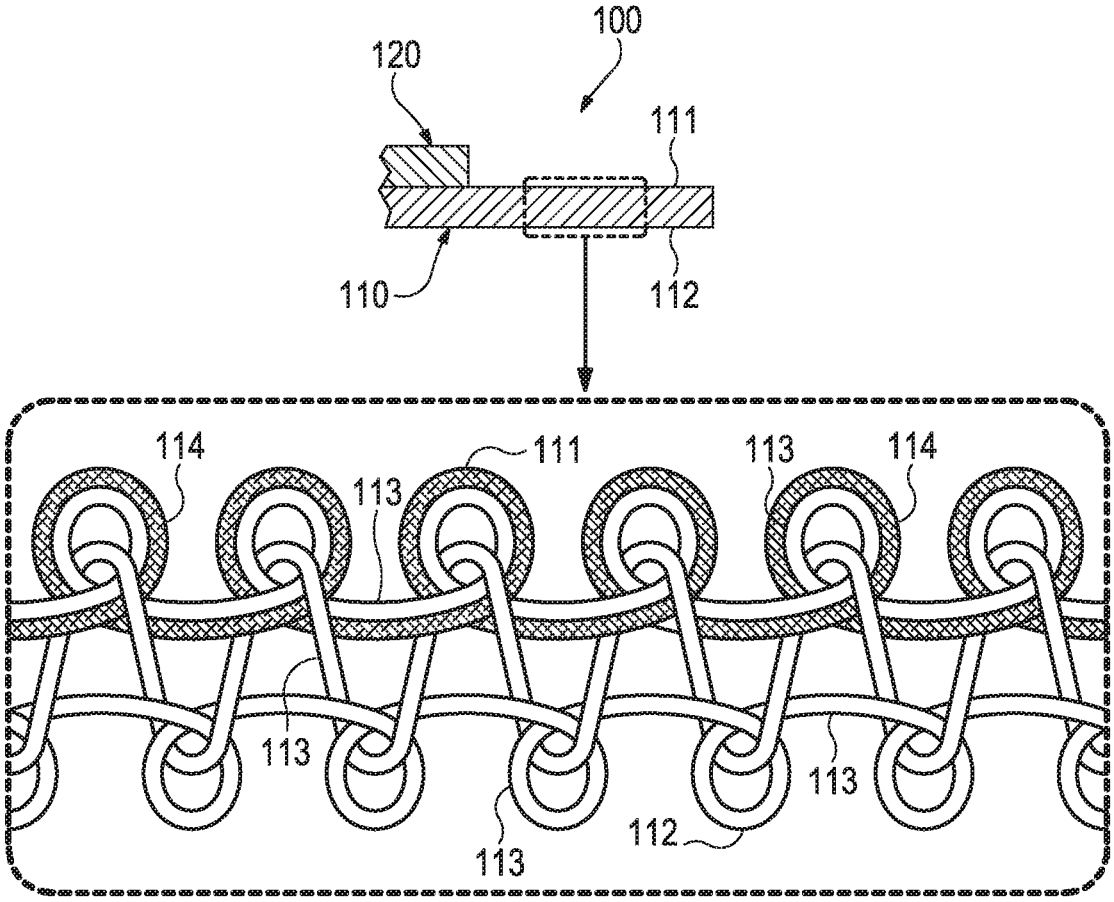
Figure 4C:
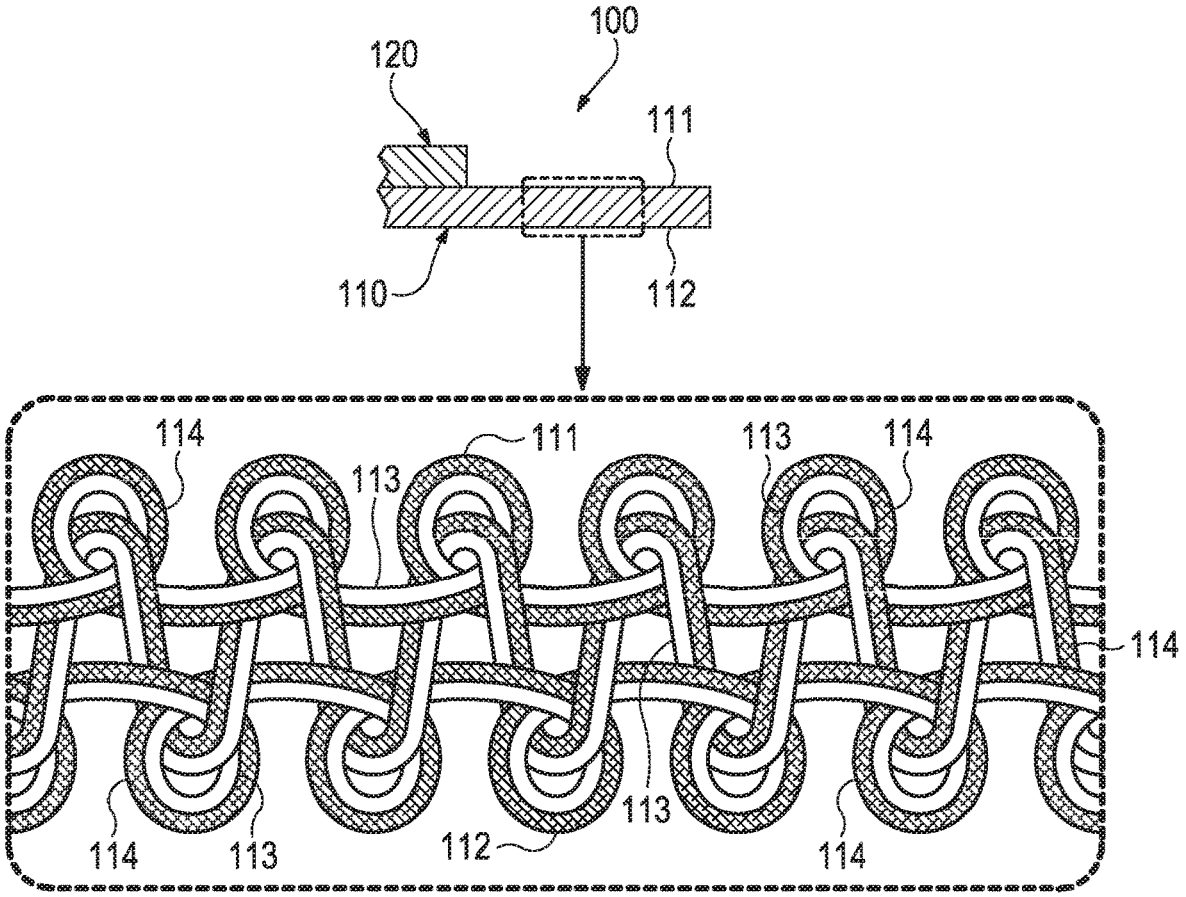

Although the configuration of FIG. 3 provides a suitable structure for forming a thermal bond between components 110 and 120, a variety of other knitted structures may also form a thermal bond. Referring to FIG. 4A, for example, non-fusible yarn 113 effectively extends throughout knit component 110 and from first surface 111 to second surface 112, whereas fusible yarn 114 is concentrated at both surfaces 111 and 112. As another example, FIG. 4B depicts a configuration wherein the portion of fusible yarn 114 located at first surface 111 is plated with a portion of non-fusible yarn 113. That is, yarns 113 and 114 run in parallel along first surface 111. Another configuration wherein yarns 113 and 114 are plated is depicted in FIG. 4C, where yarns 113 and 114 run in parallel throughout knit component 110. Accordingly, the configurations of yarns 113 and 114 within knit component 110 may vary considerably.

Referring again to FIG. 3, fusible yarn 114 is concentrated at first surface 111 and forms loops that extend around sections of non-fusible yarn 113. One consideration regarding this configuration relates to the potential for unraveling or releasing. When heated, the thermoplastic polymer material of fusible yarn 114 may soften or melt, which may effectively release the sections of non-fusible yarn 113. That is, the melting or softening of the thermoplastic polymer material of fusible yarn 114 may allow the knitted structure of knit component 110 to unravel, become non-cohesive, or otherwise release because fusible yarn 114 is no longer forming loops that hold the knitted structure together. In order to prevent this occurrence, the configurations of FIGS. 4B and 4C may be utilized. That is, yarns 113 and 114 may be plated so that they run in parallel. When fusible yarn 114 softens or melts, therefore, non-fusible yarn 113 remains intact and effectively holds the knitted structure together.

Figure 5A:
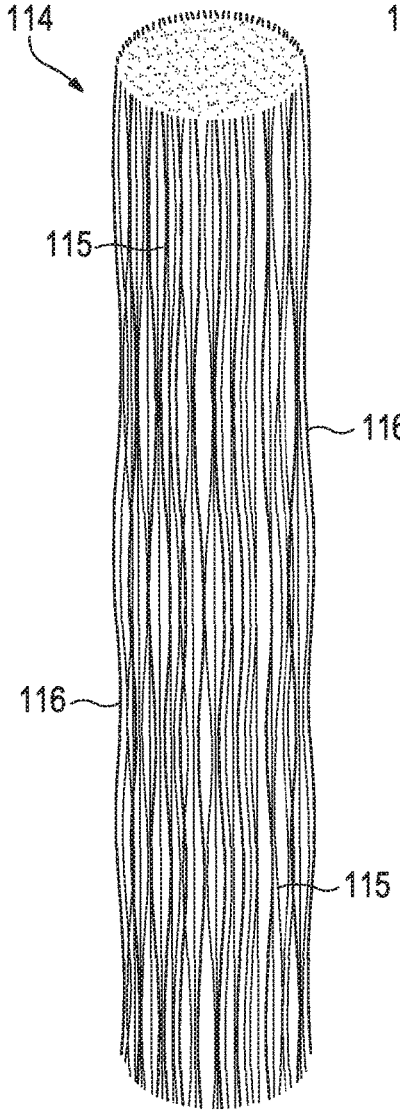
FIGS. 5A-5C are perspective views of various configurations of a fusible yarn from the knit component.
Figure 5B:
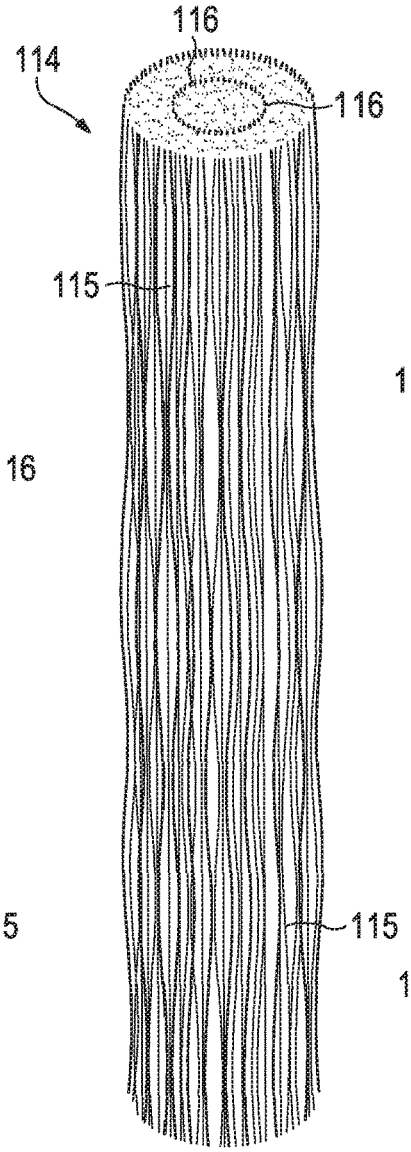
Figure 5C:
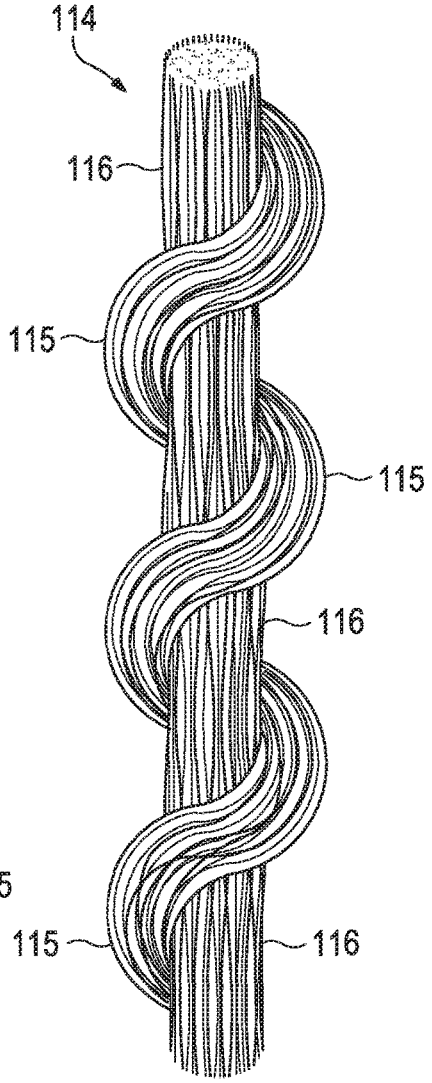

A further method of ensuring that the melting or softening of the thermoplastic polymer material in fusible yarn 114 does not release the knitted structure is to form portions of fusible yarn 114 from both fusible and non-fusible materials. Referring to FIG. 5A, for example, a portion of fusible yarn 114 is depicted as having various fusible filaments 115 and non-fusible filaments 116. Even when fusible filaments 115 melt or soften, non-fusible filaments 116 are present to prevent the knitted structure from releasing. In a similar configuration, FIG. 5B depicts filaments 115 and 116 as forming a sheath-core structure. That is, fusible filaments 115 are located peripherally to form a sheath and non-fusible filaments 116 are located centrally to form a core. Similarly, FIG. 5C depicts a configuration wherein fusible filaments 115 spiral around a core formed by non-fusible filaments 116.

Figure 6A:
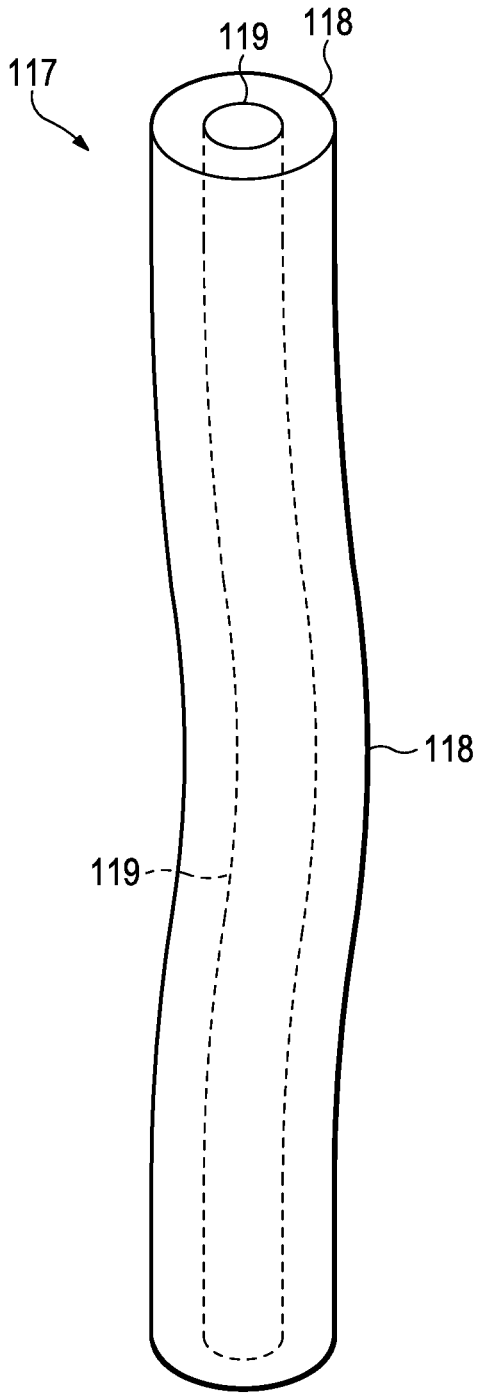
FIGS. 6A and 6B depict configurations of a filament of the fusible yarn from the knit component.
Figure 6B:
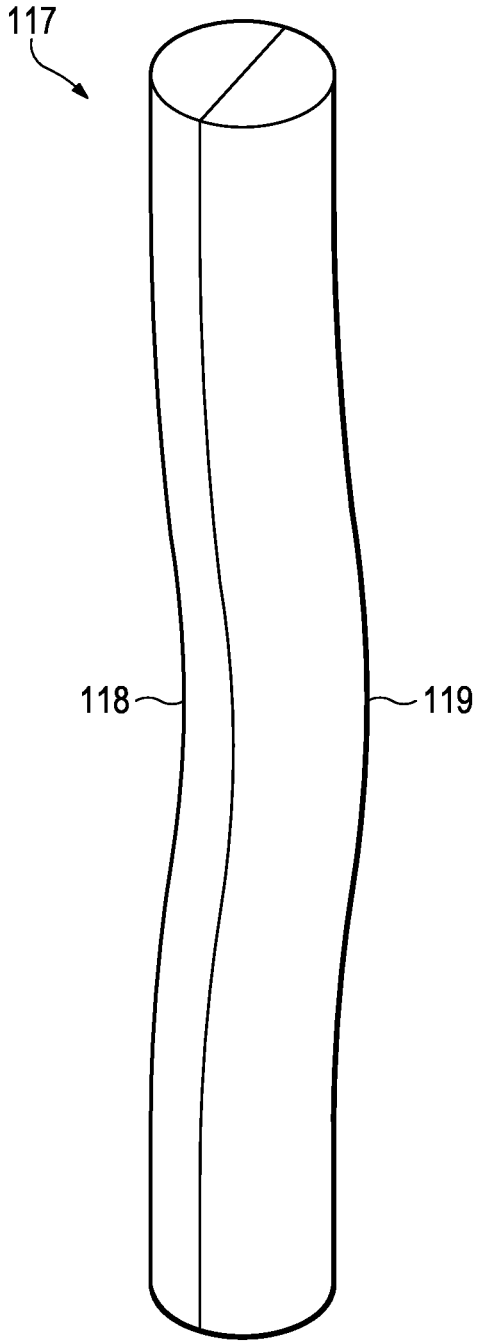

Yet another method of ensuring that the melting or softening of the thermoplastic polymer material in fusible yarn 114 does not release the knitted structure is to form individual filaments within fusible yarn 114 from both fusible and non-fusible materials. Referring to FIG. 6A, for example, an individual filament 117 includes a fusible portion 118 and a non-fusible portion 119 in a sheath-core configuration. That is, fusible portion 118 is located peripherally to form a sheath and non-fusible portion 119 is located centrally to form a core. In another configuration, FIG. 6B depicts filament 117 as having one half formed from fusible portion 118 and another half formed from non-fusible portion 119. Fusible yarn 114 may, therefore, be formed from multiple filaments 117 that will only partially melt or soften when exposed to heat.

Figure 7A:
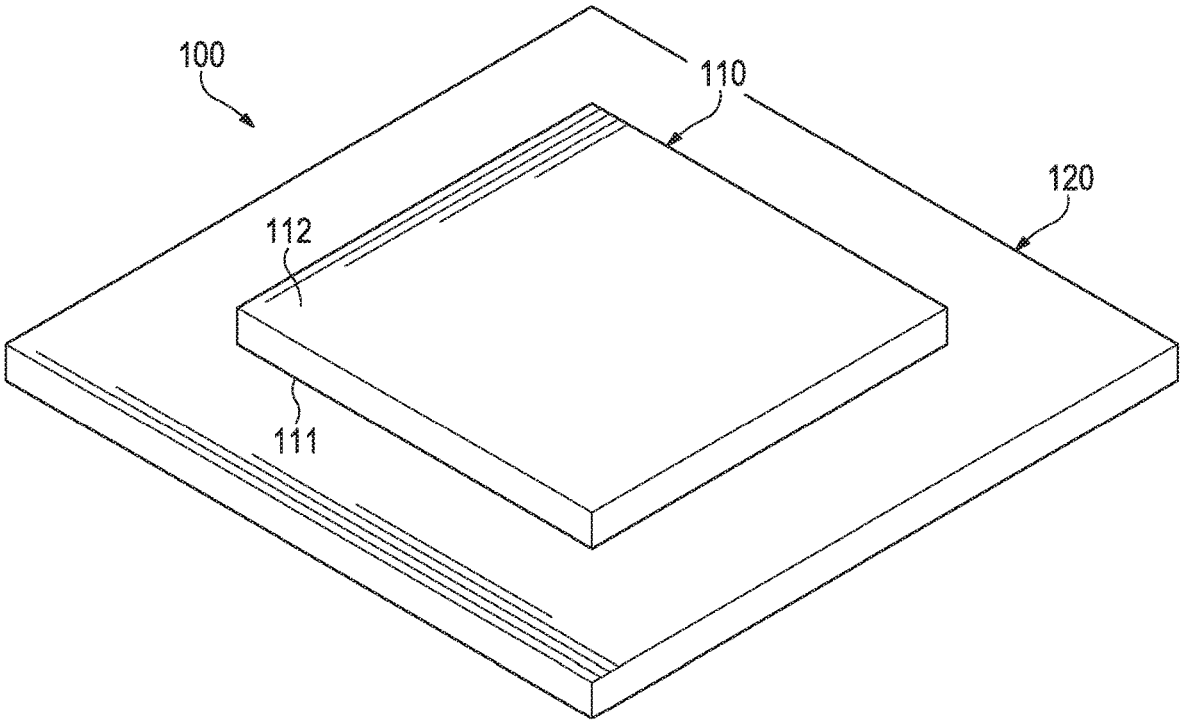
FIGS. 7A-7J are perspective views corresponding with FIG. 1 and depicting further configurations of the composite element.
Figure 7B:
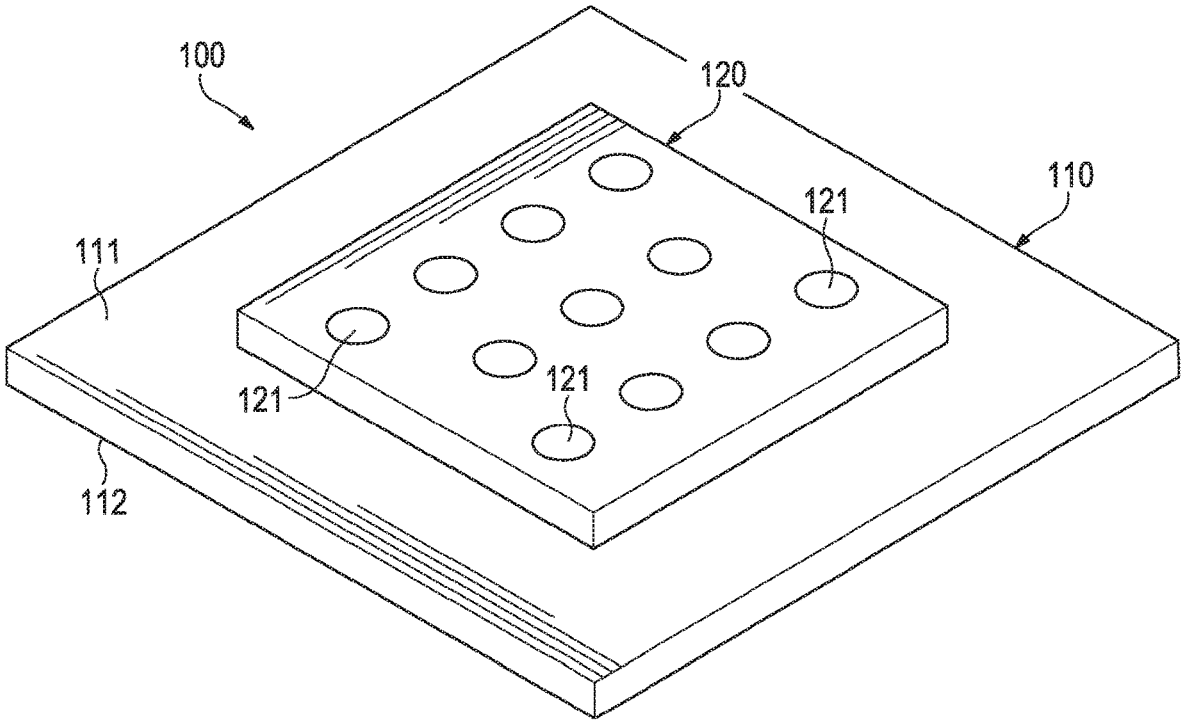
Figure 7C:
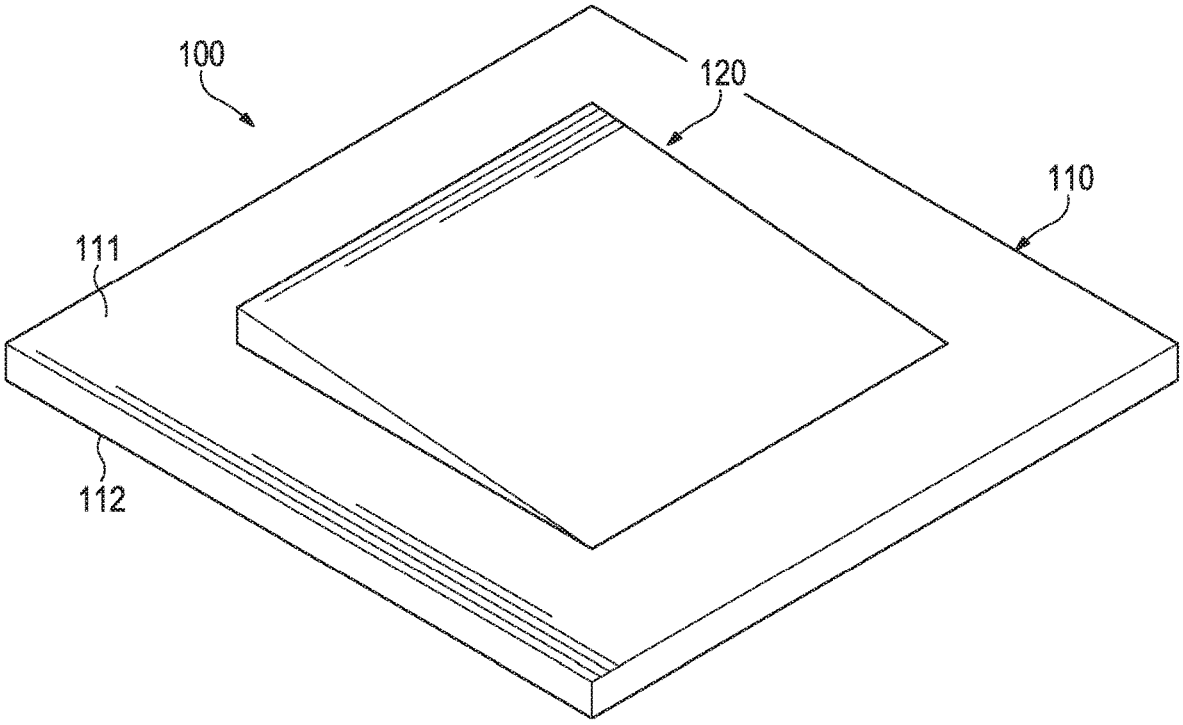
Figure 7D:
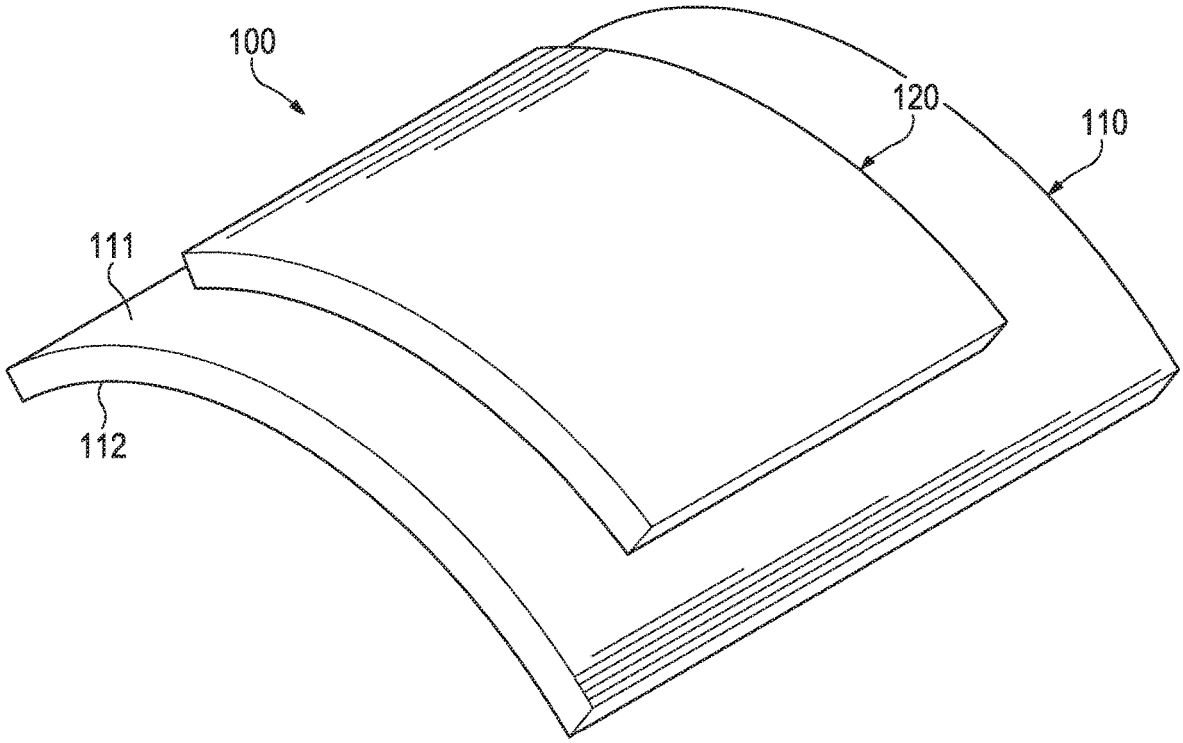
Figure 7E:
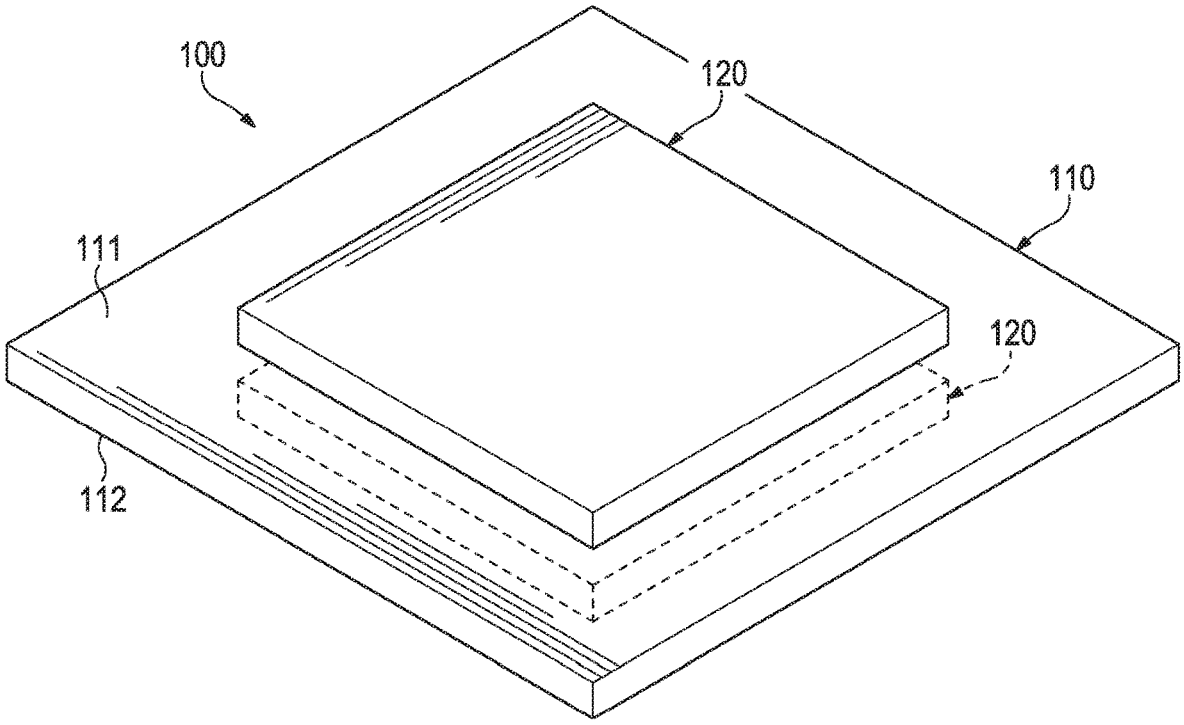

The configuration of composite element 100 in FIGS. 1-3 provides an example of the manner in which knit component bonding may be utilized to join components 110 and 120. Given that knit component bonding may be utilized in various products, numerous aspects relating to composite element 100 may vary from the configuration depicted in FIGS. 1-3. Moreover, variations in either of components 110 and 120 may alter the properties of composite element 100, thereby enhancing the products in which knit component bonding is utilized. Referring to FIG. 7A, for example, bonded component 120 is depicted as having a greater size than knit component 110. FIG. 7B depicts a configuration wherein bonded component 120 forms a plurality of apertures 121. When bonded component 120 is a polymer sheet, polymer foam element, or plate, for example, apertures 121 may be utilized to enhance the fluid permeability or flexibility of composite element 100. Although both components 110 and 120 may have constant thickness, one or both of components 110 and 120 may also have a varying thickness. Referring to FIG. 7C, for example, bonded component 120 has a tapered configuration. Although both components 110 and 120 may be planar, one or both of components 110 and 120 may also have a contoured configuration. Referring to FIG. 7D, for example, components 110 and 120 are curved. In the configurations of FIGS. 5A and 5C, fusible yarn 114 is concentrated at both surfaces 111 and 112. This may provide the advantage of allowing bonded components 120 to be thermal bonded to either of surfaces 111 and 112. For example, FIG. 7E depicts a configuration wherein one bonded component 120 is thermal bonded to first surface 111 and another bonded component 120 is thermal bonded to second surface 112.

Figure 7F:
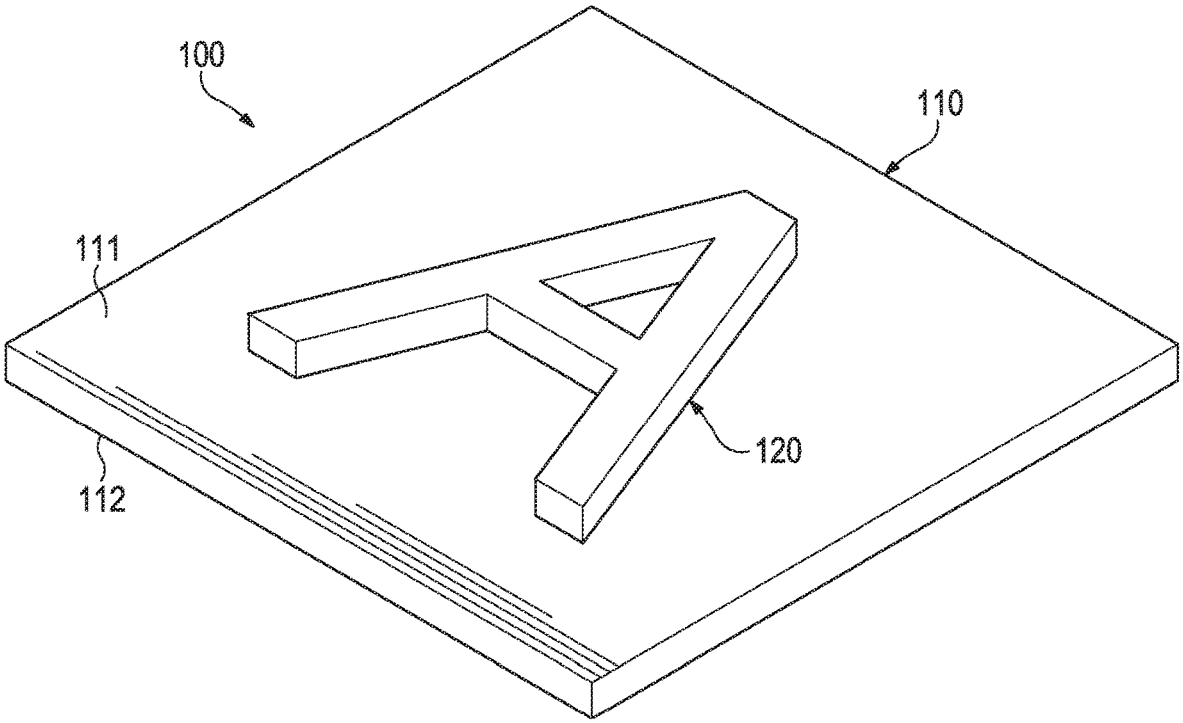
Figure 7G:
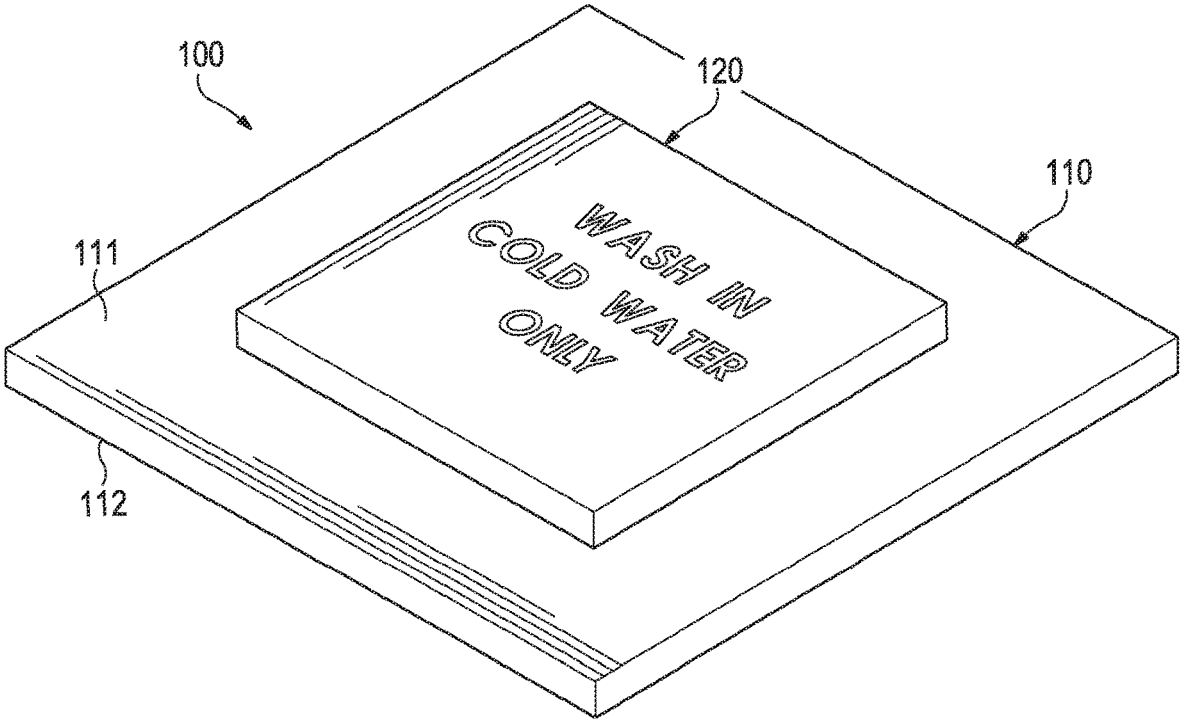

In addition to the various structural aspects of different configurations of composite element 100 depicted in FIGS. 7A-7E, some configurations of composite element 100 may provide aesthetic, informational, or other nonstructural benefits. Referring to FIG. 7F, for example, bonded component 120 is a letter "A" that is secured to knit component 110 through knit component bonding. The letter "A" or other indicia may be utilized to impart information about a product, such as trademarks of the manufacturer. Similarly, FIG. 7G depicts bonded component 120 as being a placard having care instructions, as for an article of apparel.

Figure 7H:
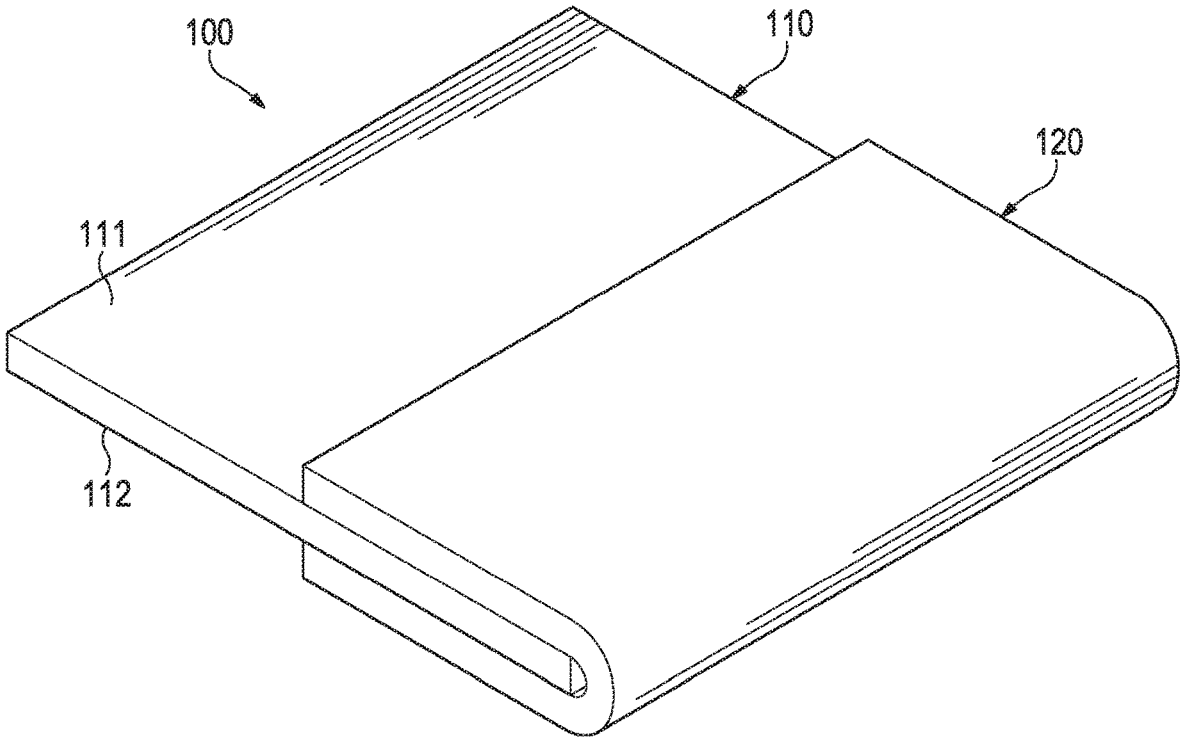
Figure 7I:
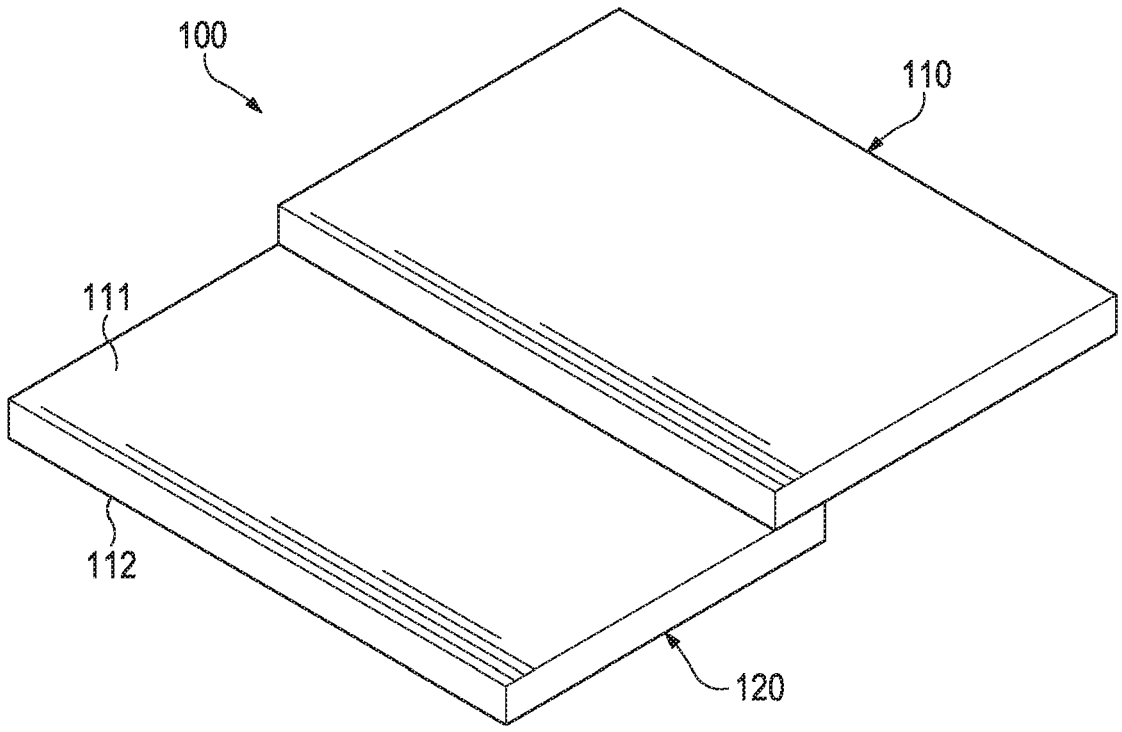
Figure 7J:
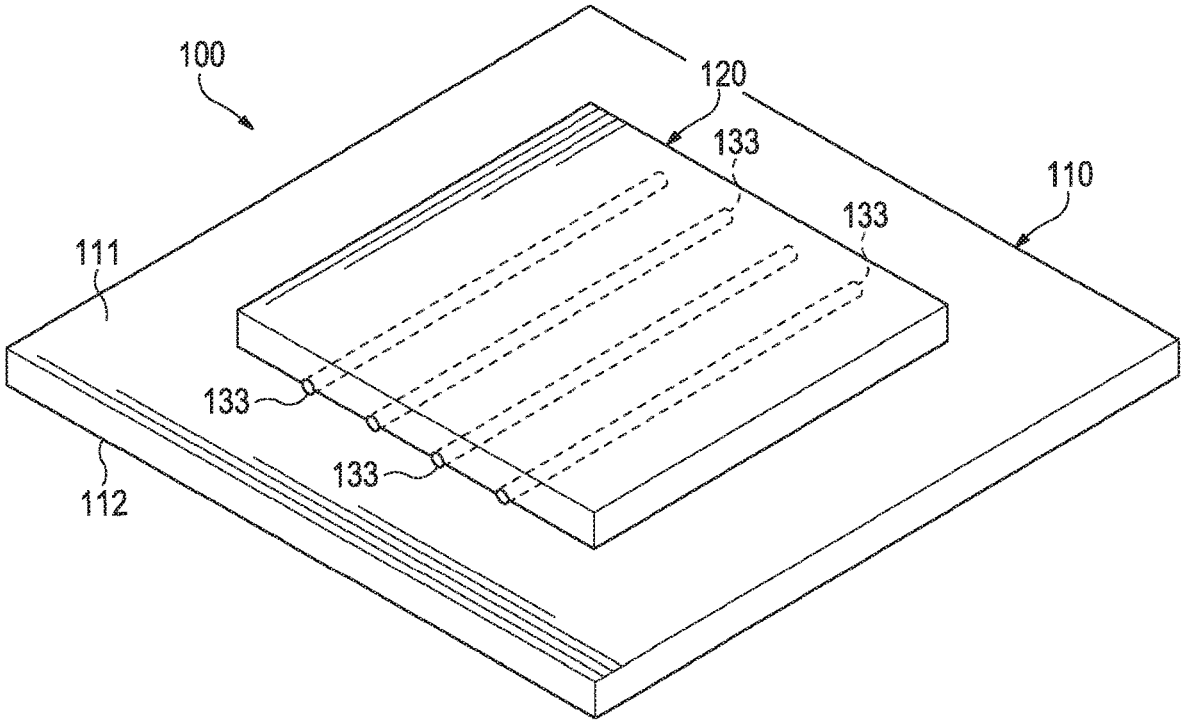

Referring to FIGS. 5A and 5C, fusible yarn 114 is located on both surfaces 111 and 112. In these configurations, bonded component 120 may be secured to either of surfaces 111 and 112. Referring to FIG. 7H, bonded component 120 may also wrap around knit component 110, thereby being bonded to both of surfaces 111 and 112. In another configuration, components 110 and 120 may be thermal bonded at their edges, as depicted in FIG. 7I, in order to replace stitching and form a seam between components 110 and 120. Referring to FIG. 7J, various strands 133 may be located between and thermal bonded between components 110 and 120. Strands 133 may, for example, resist stretch in directions corresponding with their lengths. As such, the combination of components 110 and 120 and strands 133 may be utilized in footwear, for example, as disclosed in U.S. Pat. No. 7,770,307 to Meschter, which is incorporated herein by reference.

An advantage of composite element 100 is that properties from both components 110 and 120 combine to enhance the overall properties of composite element 100. In configurations where bonded component 120 is a textile, bonded component 120 may have different textile properties than knit component 110. The resulting composite element 100 may, therefore, exhibit the textile properties of both components 110 and 120. When bonded component 120 is a polymer sheet, bonded component 120 may impart resistance to fluid permeability or wear resistance. If, for example, bonded component 120 is formed from a compressible material, such as a polymer foam element, then composite element 100 may be suitable for articles of apparel where cushioning (i.e., attenuation of impact forces) is advantageous, such as padding for athletic activities that may involve contact or impact with other athletes or equipment. Similar protective attributes may be present when bonded component is a plate.

The combination of properties from components 110 and 120 may also be present when methods other than knit component bonding (e.g., adhesives, stitching) are utilized to join components 110 and 120. An advantage to knit component bonding however, is that no adhesives or other elements are present between components 110 and 120. For example, some adhesives (e.g., hot melt) may impair fluid permeability through composite element 100. Also, adhesives may be visible around edges of bonded component 120, thereby decreasing the aesthetic appeal of a product. Moreover, forming stitching may be a time-consuming process, the stitches may compress either of components 110 and 120, and the stitches may be visible from the exterior of composite element 100. Accordingly, knit component bonding 100 may be utilized to alleviate the disadvantages discussed above, for example, in other joining methods.

Fusible yarn 114 may extend throughout knit component 110. In addition to imparting the advantage of knit component bonding, fusible yarn 114 may have the effect of stiffening or rigidifying the structure of knit component 110. More particularly, fusible yarn 114 may also be utilized to join one portion of non-fusible yarn 113 to another portion of non-fusible yarn 113, which has the effect of securing or locking the relative positions of non-fusible yarn 113, thereby imparting stretch-resistance and stiffness. That is, portions of non-fusible yarn 113 may not slide relative to each other when fused by fusible yarn 114, thereby preventing warping or permanent stretching of knit component 110 due to relative movement of the knitted structure. Another benefit relates to limiting unraveling if a portion of knit component 110 becomes damaged or a portion of non-fusible yarn 113 is severed.

Figure 8A:
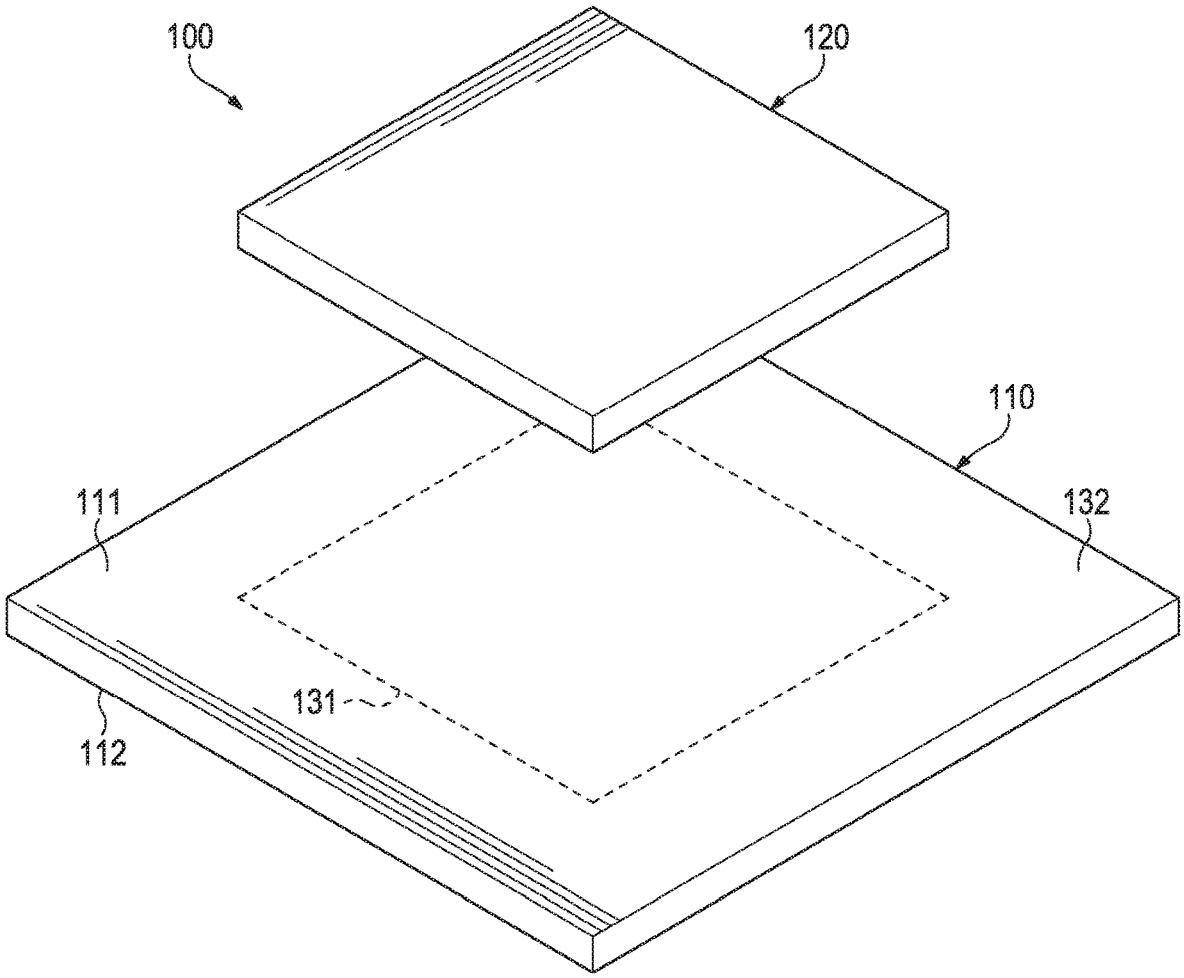
FIG. 8A-8C are exploded perspective views corresponding with FIG. 2 and depicting further configurations of the composite element.
Figure 8B:
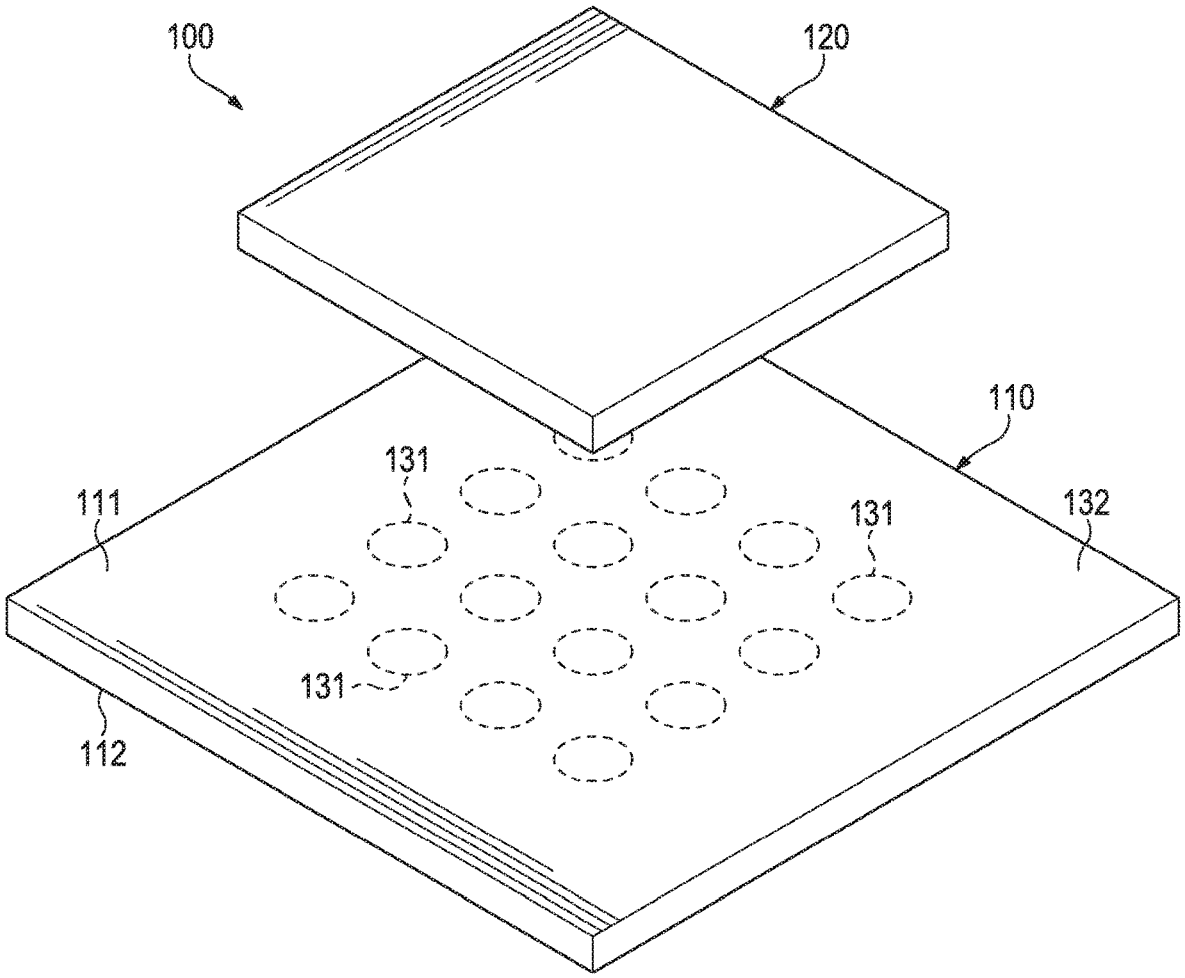

Although fusible yarn 114 may extend throughout knit component 110, fusible yarn 114 may be limited to specific areas of knit component 110. Referring to FIG. 8A, for example, an exploded perspective view of composite element 100 depicts knit component 110 as having a bonding area 131 and a peripheral area 132. Bonding area 131 corresponds with the portion of first surface 111 where bonded element 120 is thermal bonded to knit component 110. Moreover, fusible yarn 114 may be limited to bonding area 131. That is, fusible yarn 114 may be absent from peripheral area 132. In some configurations, an advantage may be gained by not joining one portion of non-fusible yarn 113 to another portion of non-fusible yarn 113 in peripheral area 132. Accordingly, by placing fusible yarn 114 in specific areas of knit component 110, knit component bonding may be performed in those areas, while reducing the effects of fusible yarn 114 in other areas. A similar configuration is depicted in FIG. 8B, wherein various bonding areas 131 are formed in the portion of first surface 111 where bonded element 120 is joined to knit component 110. In some configurations, bonding areas 131 may be individual stitches where fusible yarn 114 is present and exposed on first surface 111.

Figure 8C:
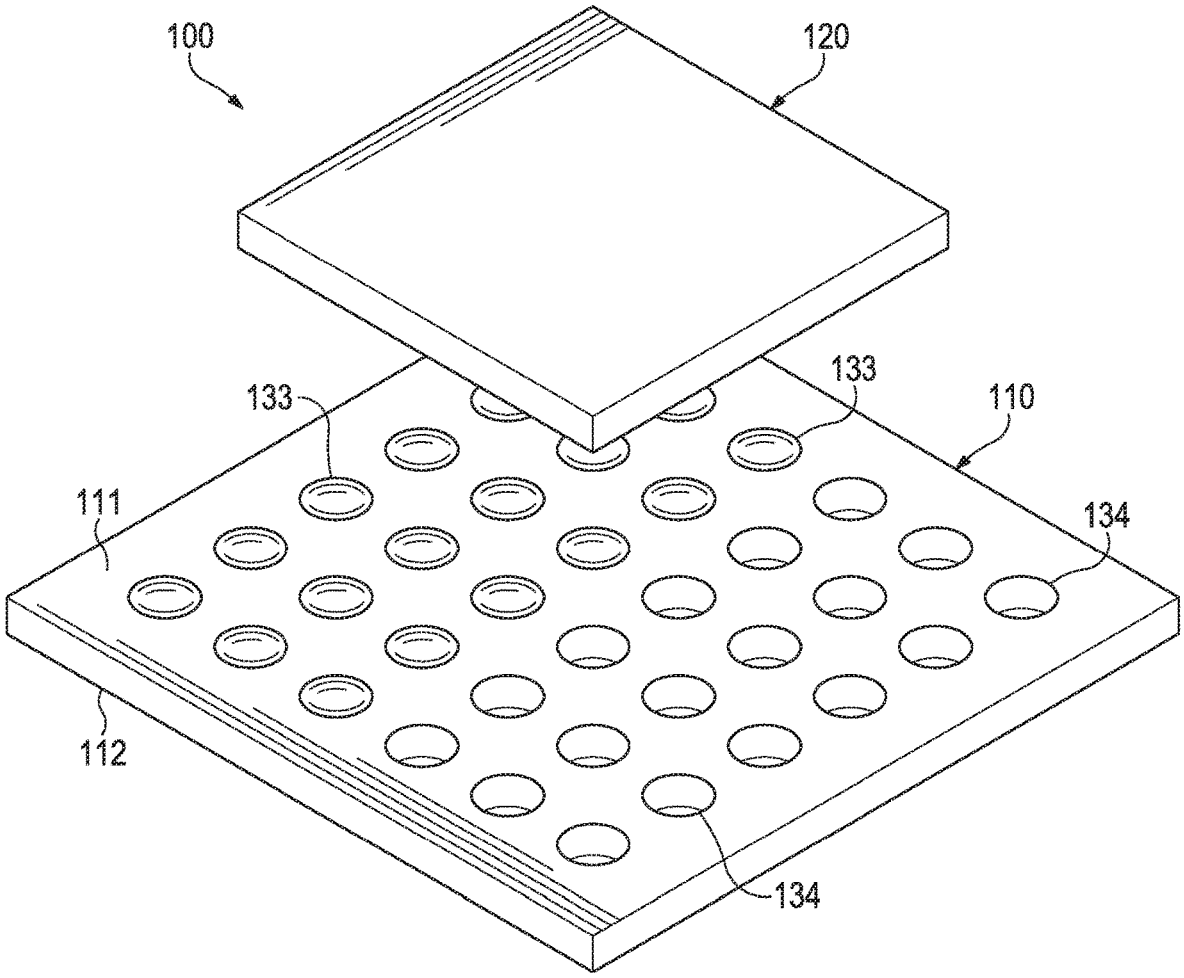

Knit component 110 may have a generally planar and continuous configuration. In some configurations, as depicted in FIG. 8C, the knitted structure of knit component 110 may define various indentations 133 or apertures 134. That is, the knitted structure may be knit to form surface features or other elements by varying the knitted structure in specific locations. Alternately, indentations 133 or other surface features may be formed through embossing, for example. In addition to enhancing the aesthetic appeal of composite element 100, indentations 133 and apertures 134 may increase properties such as fluid permeability and flexibility, while decreasing the overall mass of composite element 100.

Based upon the above discussion, composite element 100 has a configuration wherein components 110 and 120 are secured together through knit component bonding. In general, knit component bonding includes utilizing a fusible material (e.g., a thermoplastic polymer material in fusible yarn 114) within knit component 110 to form a thermal bond that joins or otherwise secures components 110 and 120 to each other. The various configurations of composite element 100 discussed above provide examples of general configurations in which knit component bonding may be implemented. As such, the various configurations of composite element 100 may be utilized in a variety of products to impart a range of benefits to those products.

Bonding Process

The general process by which knit component bonding is performed will now be discussed in detail. As a preliminary aspect of the process, knit component 110 is formed through a knitting process. Generally, a knitting machine may be programmed to knit a textile (i.e., knit component 110) with non-fusible yarn 113 and fusible yarn 114. Moreover, the knitting machine may also locate fusible yarn 113 on at least one surface, such as first surface 111. In effect, therefore, the knitting process may include concentrating fusible yarn 114 at first surface 111. In some configurations, the knitting process may also extend fusible yarn 114 from first surface 111 to second surface 112 or plate yarns 113 and 114. Hand knitting, rather than machine knitting, may also be utilized.

Figure 9A:
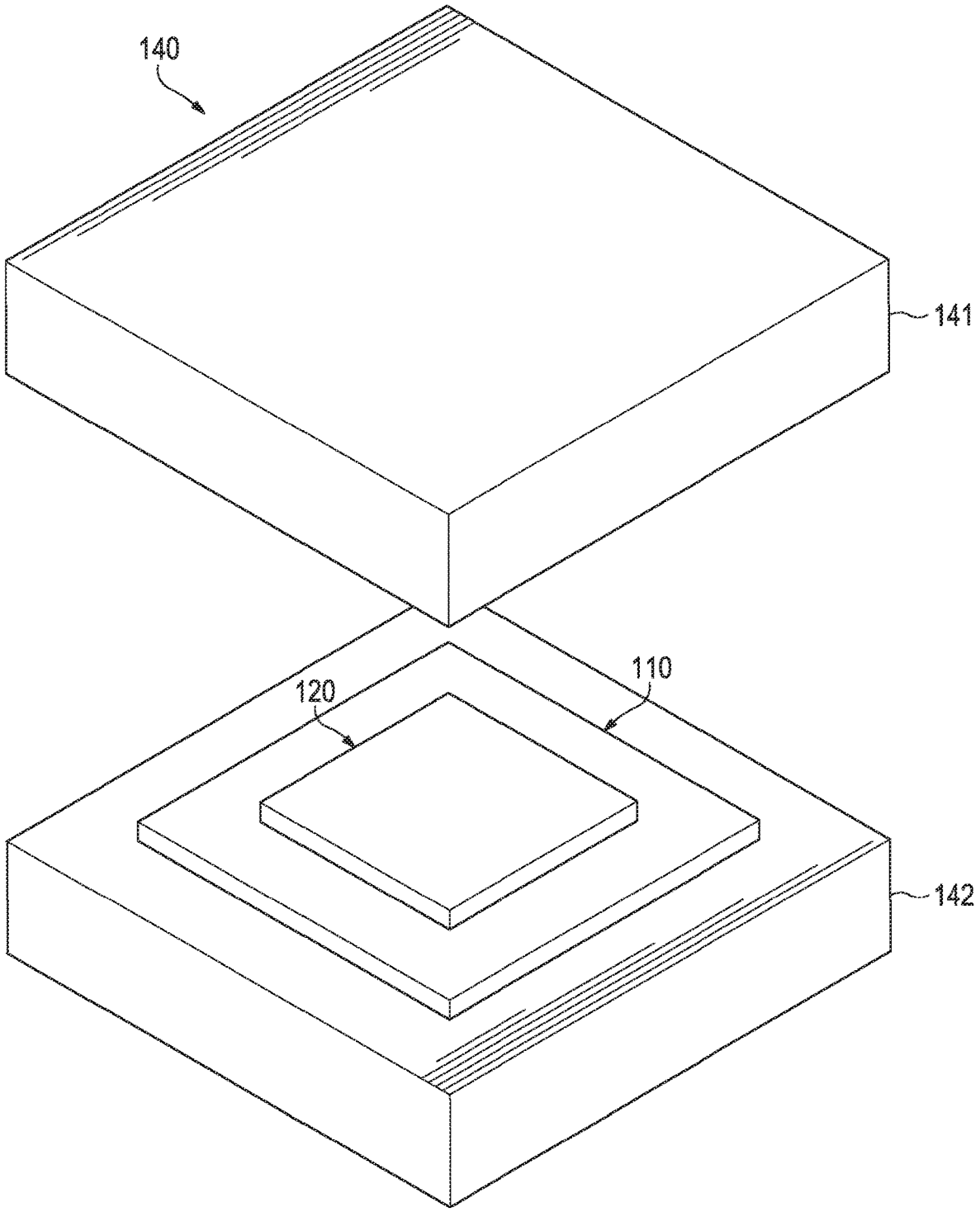
FIGS. 9A-9C are schematic perspective views of a process for performing knit component bonding.
Figure 9B:
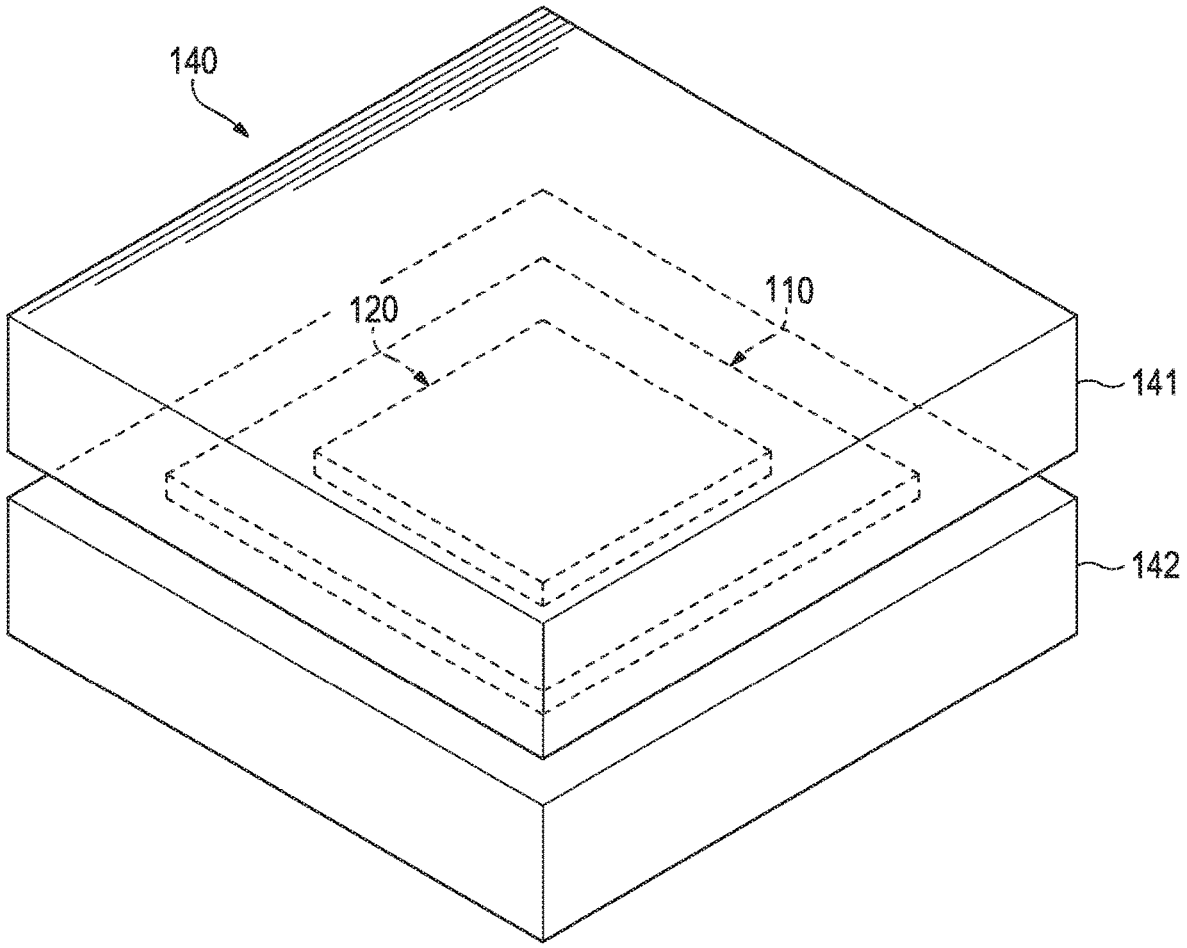
Figure 9C:
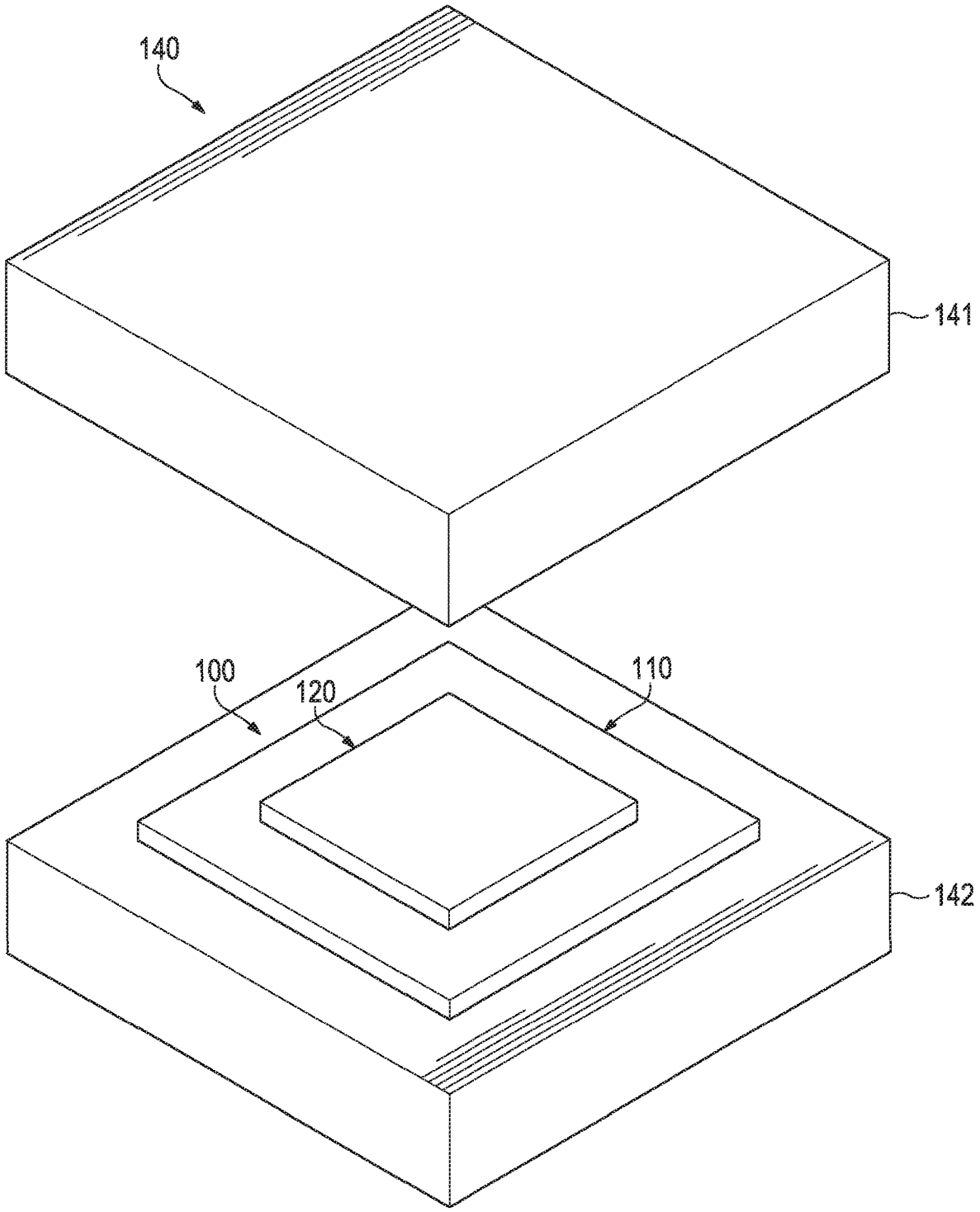

Once knit component 110 is formed, both of components 110 and 120 may be placed within a heat press 140, as depicted in FIG. 9A. More particularly, bonded component 120 may be placed adjacent to a portion of first surface 111 where bonding is intended to occur, and both of components 110 and 120 may be located between opposing portions 141 and 142 of heat press 140. Once positioned, portions 141 and 142 may translate toward each other to compress and apply heat to components 110 and 120, as depicted in FIG. 9B. That is, components 110 and 120 may be compressed and heated to a temperature that causes the thermoplastic polymer material in fusible yarn 114 to melt or soften. Due to the compression from portions 141 and 142, portions of the melted or softened thermoplastic polymer material may contact or otherwise engage bonded component 120. Following sufficient heating and compression, portions 141 and 142 separate, as depicted in FIG. 9C, and components 110 and 120 may be removed. Following cooling, the thermoplastic polymer material from fusible yarn 114 securely forms a thermal bond that joins components 110 and 120 to each other.

Heat press 140 provides an advantage of simultaneously heating and compressing components 110 and 120. In other bonding processes, components 110 and 120 may be heated prior to being compressed within heat press 140 or a cold press. Examples of heating methods that may be utilized include conduction, infrared, ultrasonic, high frequency, radio frequency, vibration heating, and steam heating.

Product Configurations

Following the process of knit component bonding discussed above, composite element 100 may be incorporated into one of various products, including many of the products discussed in the Background above. As specific examples of products that may incorporate concepts associated with knit component bonding, two articles of apparel, a shirt 200 and an article of footwear 300, will now be discussed.

Figure 10:
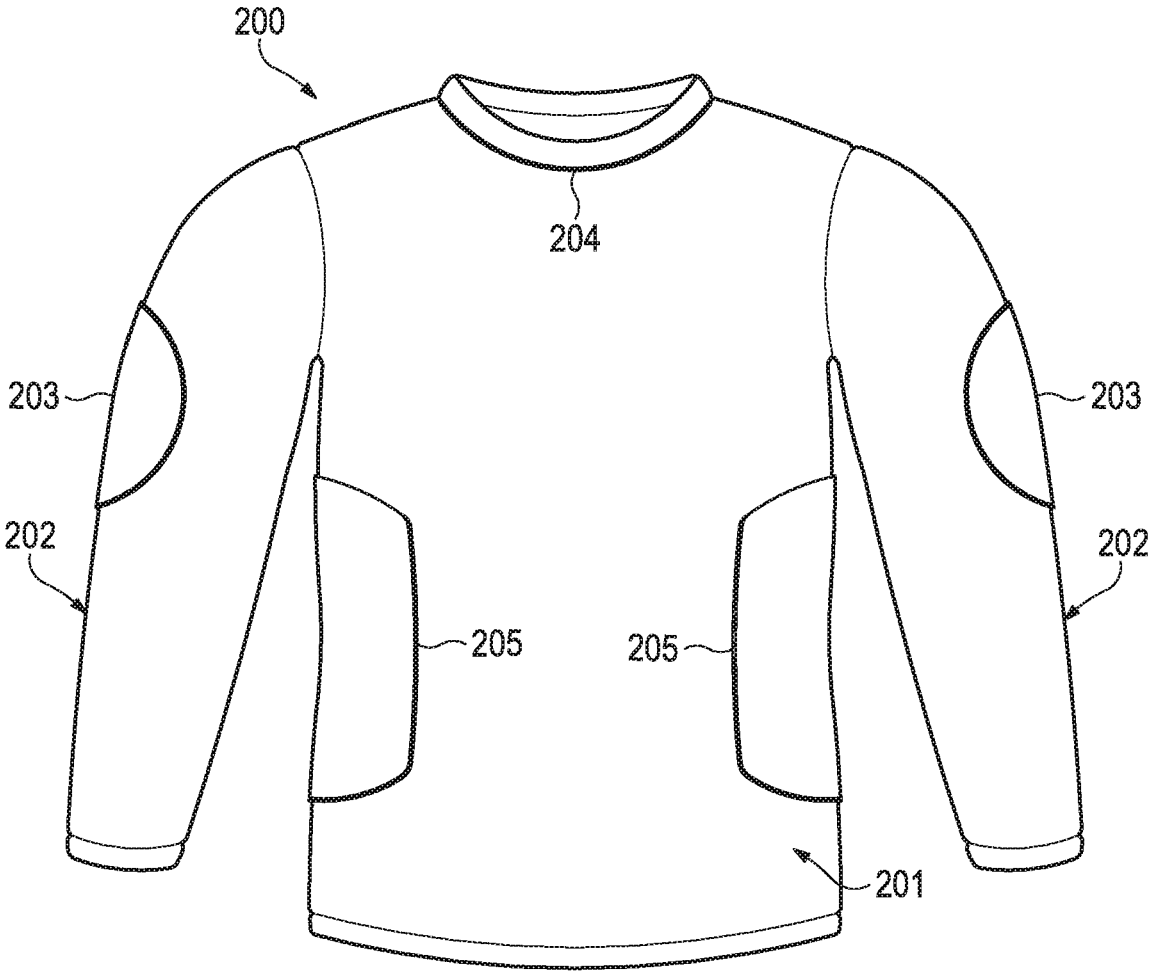
FIG. 10 is an elevational view of an article of apparel having a configuration of a shirt.

Shirt 200 is depicted in FIG. 10 as including a torso region 201 and a pair of arm regions 202 that extend outward from torso region 201. Torso region 201 corresponds with a torso of a wearer and covers at least a portion of the torso when worn. Similarly, arm regions 202 correspond with arms of the wearer and cover at least a portion of the arms when worn. Torso region 201 and arm regions 202 may both be formed from a textile that is similar to knit component 110. That is, the textile forming torso region 201 and arm regions 202 may be at least partially formed from a yarn incorporating a fusible material, which has properties similar to fusible yarn 114. Moreover, the fusible material may be oriented to form at least a portion of the exterior surface of shirt 200. The textile forming torso region 201 and arm regions 202 may also be at least partially formed from a yarn incorporating a non-fusible material, which has properties similar to non-fusible yarn 113.

Given the configuration of shirt 200 discussed above, various components 203205 may be secured to shirt 200 through knit component bonding. Referring specifically to FIG. 10, two components 203 are secured to elbow areas of arm regions 202 and may be polymer or leather sheets that provide wear resistance to the elbow areas. Component 204 is also located around a neck opening of torso region 201 and may be a polymer sheet that enhances the stretch-resistance of the area around the neck opening. Additionally, two components 205 are bonded to side areas of torso region 201 and may be polymer foam elements that attenuate forces impacting the sides of the wearer during athletic activities. Accordingly, the general concepts of knit component bonding may be utilized in shirt 200 to impart a variety of benefits. Moreover, similar concepts may be applied to a variety of other types of apparel to impart similar benefits, including headwear, pants, undergarments, socks, and gloves.

Figure 11:
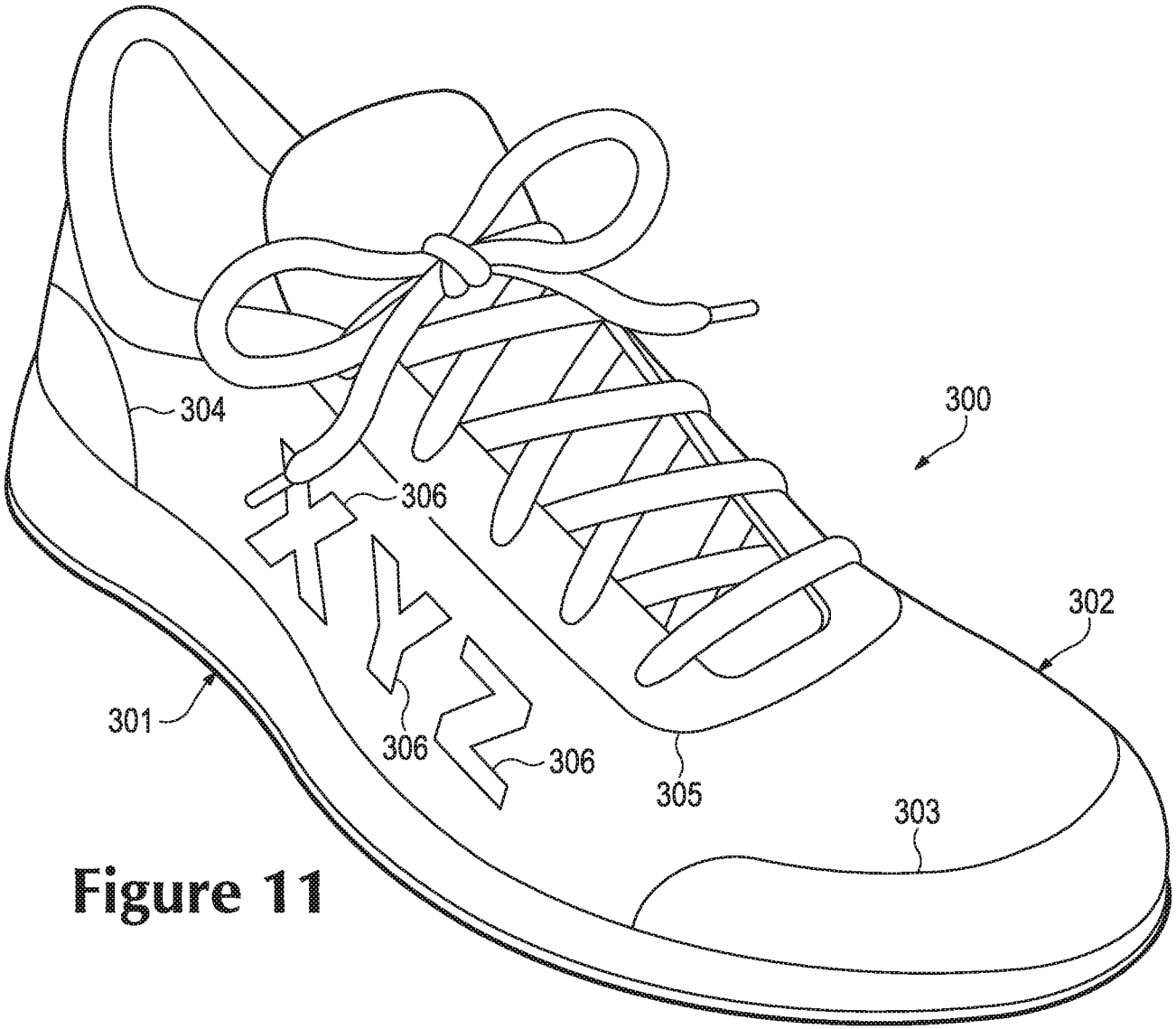
FIG. 11 is a perspective view of an article of footwear.
Figure 12:
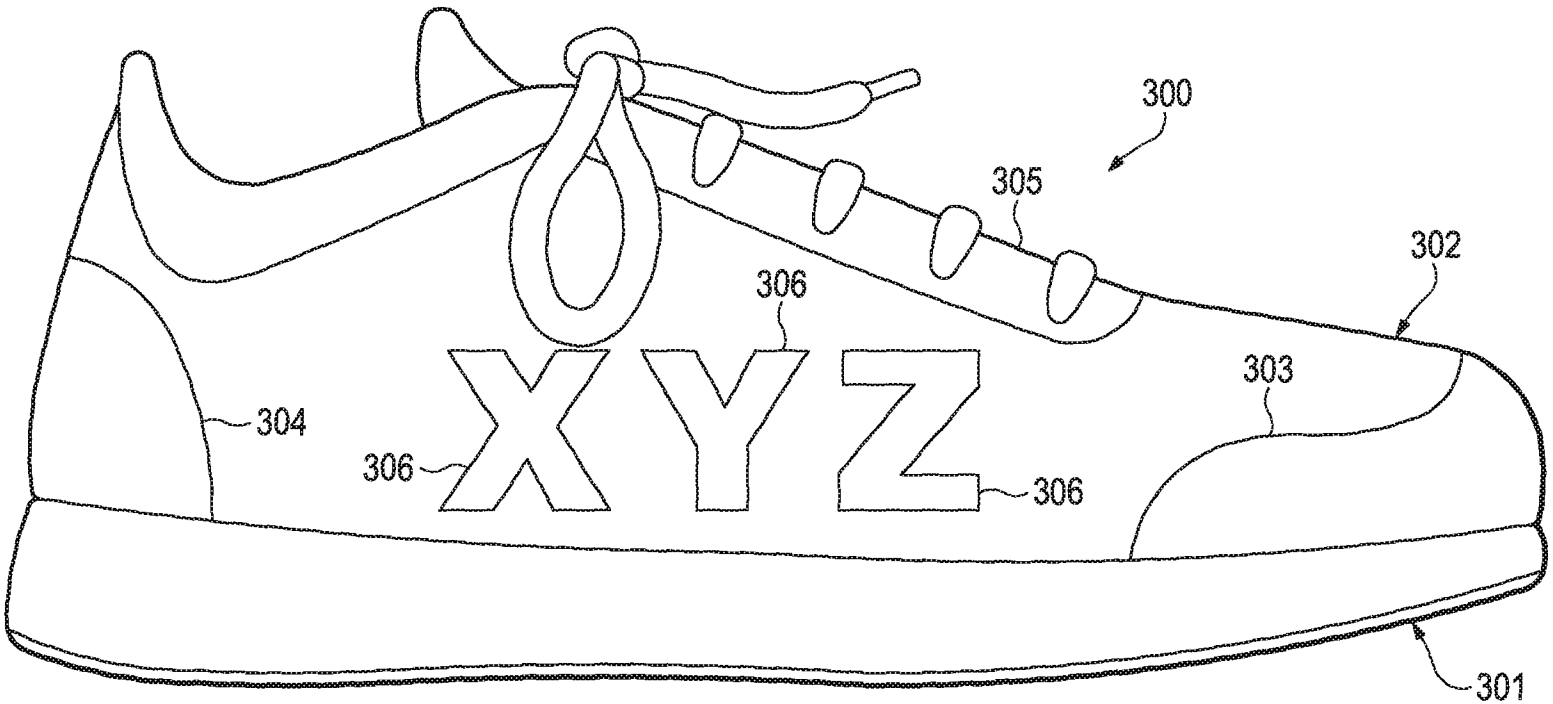
FIG. 12 is a lateral side elevational view of the article of footwear.
Figure 13:
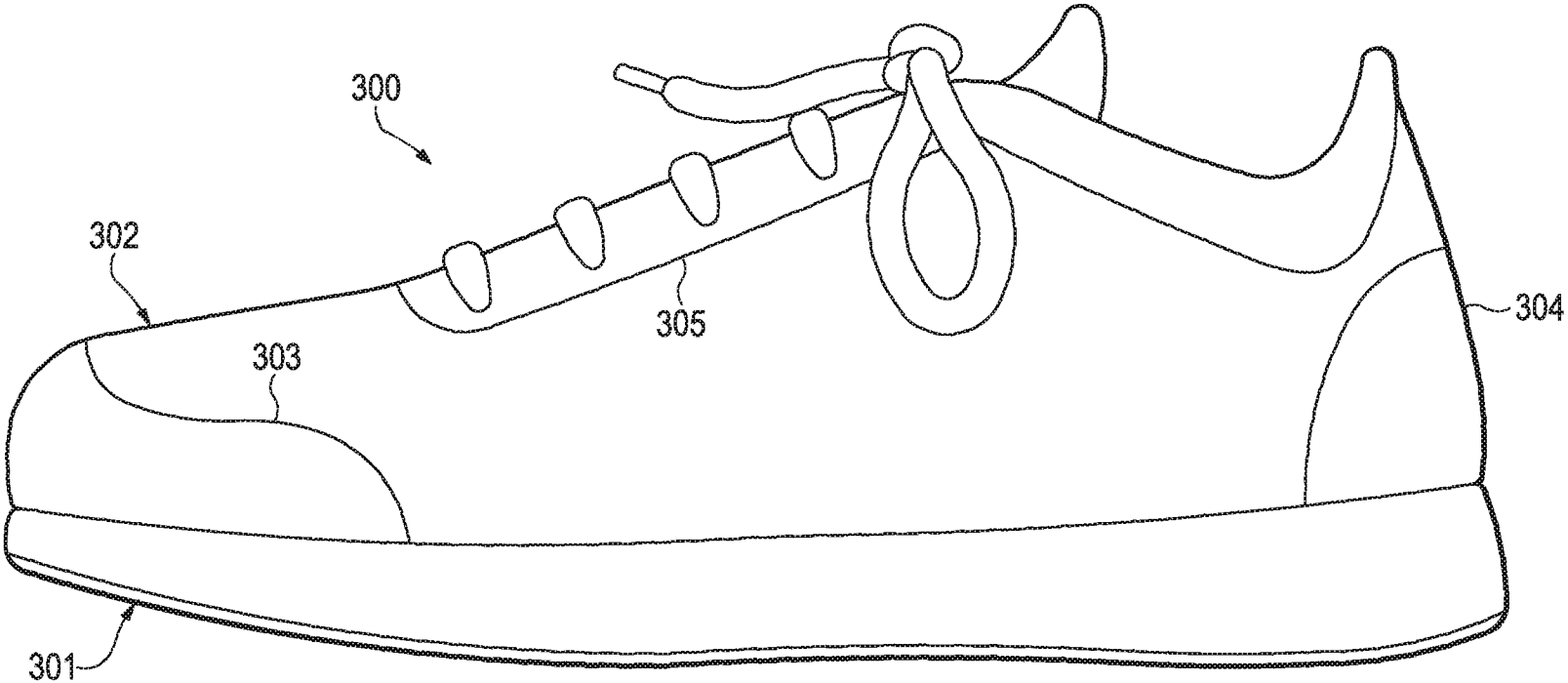
FIG. 13 is a medial side elevational view of the article of footwear.

Another article of apparel, footwear 300, is depicted in FIGS. 11-13 as including a sole structure 301 and an upper 302. Although footwear 300 is depicted as having a configuration that is suitable for running, the concepts of knit component bonding may be applied to a wide range of athletic footwear styles, including basketball shoes, biking shoes, cross-training shoes, football shoes, golf shoes, hiking shoes and boots, ski and snowboarding boots, soccer shoes, tennis shoes, and walking shoes, for example. Concepts associated with knit component bonding may also be utilized with footwear styles that are generally considered to be non-athletic, including dress shoes, loafers, and sandals. Accordingly, knit component bonding may be utilized with a wide variety of footwear styles.

Sole structure 301 is secured to upper 302 and extends between the foot and the ground when footwear 300 is worn. In general, sole structure 301 may have any conventional or non-conventional configuration. Upper 302 provides a structure for securely and comfortably receiving a foot of a wearer. More particularly, the various elements of upper 302 generally define a void within footwear 300 for receiving and securing the foot relative to sole structure 301. Surfaces of the void within upper 302 are shaped to accommodate the foot and extend over the instep and toe areas of the foot, along the medial and lateral sides of the foot, under the foot, and around the heel area of the foot. In this configuration, at least an exterior surface of upper 302 may be formed from a textile similar to knit component 110. That is, the textile forming the exterior surface may be at least partially formed from a yarn incorporating a fusible material, which has properties similar to fusible yarn 114. Moreover, the fusible material may be located on at least a portion of the exterior surface. The textile may also be at least partially formed from a yarn incorporating a non-fusible material, which has properties similar to non-fusible yarn 113.

Given the configuration of footwear 300 discussed above, various components 303-306 may be secured to the textile of upper 302 through knit component bonding. As an example, component 303 is secured to a forefoot area of upper 302 and may be a polymer or leather sheet that forms a wear resistant toe guard extending from a lateral side to a medial side of footwear 300. Component 304 is located around a heel region of footwear 300 and extends from the lateral side to the medial side of footwear 300 to form a heel counter that will resist lateral movements of the foot during walking, running, and other ambulatory activities. Although component 304 is secured to the exterior surface of upper 302, component 304 may also be secured to the interior surface if a fusible material is present at the interior surface. Various polymer sheets and plates, for example, may be utilized for component 304. Component 305 may also be a polymer or leather sheet that extends around a throat area of upper 302 to reinforce lace apertures due to tension in a lace. Additionally, three components 306 forming the characters "XYZ" are located on the lateral side of upper 302 to represent a trademark or other indicia. Accordingly, the general concepts of knit component bonding may be utilized in footwear 300 to impart a variety of benefits.

In the configuration of footwear 300 disclosed above, the textile forming the exterior surface of upper 302 is noted as being partially formed from a yarn incorporating a fusible material. In the configuration depicted in FIGS. 11-13, however, the exterior surface of upper 302 may be a base element formed from any material commonly utilized in footwear uppers. That is, the exterior surface of upper may or may not include a thermoplastic polymer material. Moreover, components 303-306 may be formed from a textile incorporating a yarn with a fusible material. In other words, components 303-306 may have the configuration of knit component 110 As such, the fusible material of components 303-306 may be utilized to form a thermal bond with upper 302.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

What is claimed is:

1. An upper for an article of footwear comprising:

a knit component comprising a first area of the upper, wherein the first area comprises a first knit layer and a second knit layer and one or more synthetic filaments extending between the first knit layer and the second knit layer, the one or more synthetic filaments forming at least part of one or more of the first knit layer and the second knit layer.

2. The upper of claim 1, wherein the knit component further comprises a second area of the upper that comprises a polymer component.

3. The upper of claim 2, wherein the second area forms at least part of a forefoot area of the upper.

4. The upper of claim 3, wherein the forefoot area comprises knitted fusible material.

5. The upper of claim 4, wherein the knitted fusible material in the forefoot area is fused with knitted non-fusible material in the forefoot area.

6. The upper of claim 3, wherein the forefoot area of the upper comprises a plurality of layers.

7. The upper of claim 3, wherein the polymer component forms a polymer layer in the forefoot area.

8. The upper of claim 3, wherein the polymer component is at least one selected from a polymer sheet and a polymer foam.

9. The upper of claim 2, wherein the second area is reinforced by the polymer component and wherein the polymer component is absent from the first area.

10. The upper of claim 2, wherein the polymer component comprise a plurality of apertures.

11. The upper of claim 2 further comprising a second polymer component in a heel region of the upper.

12. The upper of claim 11, wherein the second polymer component extends between a medial side of the upper and a lateral side of the upper.

13. The upper of claim 11, wherein the second polymer component is secured to an exterior surface of the upper.

14. The upper of claim 11, wherein the second polymer component is secured to an interior surface of the upper.

15. The upper of claim 11, wherein the second polymer component is at least one selected from a polymer sheet and a polymer foam.

16. The upper of claim 1, wherein the one or more synthetic filaments comprise a fusible material.

17. An article of footwear, comprising:

a sole; and an upper secured to the sole, the upper comprising:

a knit component comprising a first area, wherein the first area comprises a first knit layer and a second knit surface layer and one or more synthetic filaments extending between the first knit layer and the second knit layer, the one or more synthetic filaments forming at least part of one or more of the first knit layer and the second knit layer.

18. The article of footwear of claim 17, wherein the knit component further comprises a second area forming at least part of a forefoot area of the upper, the second area comprising a polymer component.

19. The article of footwear of claim 18, wherein the forefoot area comprises knitted fusible material that is fused with knitted non-fusible material.

20. The article of footwear of claim 18, wherein the polymer component is absent from the first area.

* * * * *